US007503984B2

(12) United States Patent
Yokoi et al.

(10) Patent No.: US 7,503,984 B2
(45) **Date of Patent: *Mar. 17, 2009**

(54) HIGH-STRENGTH THIN STEEL SHEET DRAWABLE AND EXCELLENT IN SHAPE FIXATION PROPERTY AND METHOD OF PRODUCING THE SAME

(75) Inventors: Tatsuo Yokoi, Oita (JP); Teruki Hayashida, Oita (JP); Natsuko Sugiura, Futtsu (JP); Takaaki Nakamura, Oita (JP); Takehiro Nakamoto, Oita (JP)

(73) Assignee: Nippon Steel Corporation, Tokyo (JP)

( * ) Notice: Subject to any disclaimer, the term of this patent is extended or adjusted under 35 U.S.C. 154(b) by 241 days.

This patent is subject to a terminal disclaimer.

(21) Appl. No.: 10/491,928

(22) PCT Filed: Oct. 4, 2002

(86) PCT No.: PCT/JP02/10386

§ 371 (c)(1),
(2), (4) Date: Apr. 5, 2004

(87) PCT Pub. No.: WO03/031669

PCT Pub. Date: Apr. 17, 2003

(65) Prior Publication Data

US 2004/0244877 A1 Dec. 9, 2004

(30) Foreign Application Priority Data

Oct. 4, 2001 (JP) ..... 2001-308285
Nov. 26, 2001 (JP) ..... 2001-360084

(51) Int. Cl.
*C22C 38/14* (2006.01)
*C22C 38/02* (2006.01)
*C22C 38/04* (2006.01)
*C22C 38/06* (2006.01)

(52) U.S. Cl. ..... 148/320; 148/330; 148/331; 148/333; 148/334; 148/335; 148/336

(58) Field of Classification Search ..... 148/602, 148/603, 320, 330, 331, 333–336
See application file for complete search history.

(56) References Cited

U.S. PATENT DOCUMENTS 4,572,748 A 2/1986 Suga et al.

(Continued)

FOREIGN PATENT DOCUMENTS

DE 3007560 9/1981

(Continued)

OTHER PUBLICATIONS

The English abstract of Japanese patent 361003844, Jan. 9, 1986, Yada, Hiroshi et al.*

(Continued)

*Primary Examiner*—Deborah Yee
(74) *Attorney, Agent, or Firm*—Baker Botts LLP

(57) ABSTRACT

The present invention provides a high-strength thin steel sheet drawable and excellent in a shape fixation property and a method of producing the same. For the steel sheet, on a plane at the center of the thickness of a steel sheet, the average ratio of the X-ray strength in the orientation component group of {100}<011> to {223}<110> to random X-ray diffraction strength is 2 or more and the average ratio of the X-ray strength in three orientation components of {554}<225>, {111}<112> and {111}<110> to random X-ray diffraction strength is 4 or less. The arithmetic average of the roughness Ra of at least one of the surfaces is 1 to 3.5 μm; the surfaces of the steel sheet are covered with a composition having a lubricating effect; and the friction coefficient of the steel sheet surfaces at 0 to 200° C. is 0.05 to 0.2. Further, the present invention also relates to a method of producing said steel sheet, characterized by: rolling a steel sheet having the chemical components specified in the present invention at a total reduction ratio of 25% or more in the temperature range of the $Ar_3$ transformation temperature +100° C. or lower.

7 Claims, 2 Drawing Sheets

U.S. PATENT DOCUMENTS 6,962,631 B2 * 11/2005 Sugiura et al. ..... 148/320

FOREIGN PATENT DOCUMENTS

| | | | |
|---|---|---|---|
| DE | 3401406 | | 7/1985 |
| EP | 1026278 | | 8/2000 |
| EP | 1176217 | * | 1/2002 |
| EP | 1201780 | | 5/2002 |
| FR | 2477178 | | 9/1981 |
| JP | 02-8349 | * | 1/1990 |
| JP | 08003679 | | 1/1996 |
| JP | 2000-309848 | * | 11/2000 |
| JP | 2000-319731 | * | 11/2000 |
| WO | 9739152 | | 10/1997 |

OTHER PUBLICATIONS

The English abstract of Japanese patent 410060542, Mar. 3, 1998, Tosaka, Akio et al.*

Computer-generated English translation of Japanese patent 10-008197, Anami Goro et al., Jan. 13, 1998.*

Computer-generated English translation of Japanese patent 08-157957, Kashima Takahiro et al., Jun. 18, 1996.*

Misra et al., "Transformation textures in new ultrahigh strength hot rolled microalloyed steel," Materials Science and Technology, vol. 17, pp. 116-118, Jan. 2001.

* cited by examiner

HIGH-STRENGTH THIN STEEL SHEET DRAWABLE AND EXCELLENT IN SHAPE FIXATION PROPERTY AND METHOD OF PRODUCING THE SAME

FIELD OF THE INVENTION

The application is a national phase application of International Patent Application No. PCT/JP02/10386 filed on Oct. 4, 2002, and which published on Apr. 17, 2003 as International Patent Publication No. WO 03/031669. Accordingly, the present application claims priority from the above-referenced International application under 35 U.S.C. § 365. In addition, the present application claims priority from Japanese Patent Application Nos. 2001-308285 and 2001-360084, filed Oct. 4, 2001 and Nov. 26, 2001, respectively, under 35 U.S.C. § 119. The entire disclosures of these International and Japanese patent application are incorporated herein by reference.

FIELD OF THE INVENTION

The present invention relates to a high-strength thin steel sheet drawable and excellent in a shape fixation property, and a method of producing the steel sheet. Using the present invention, it is possible to obtain a good drawability even with a steel sheet having a texture disadvantageous for drawing work.

BACKGROUND INFORMATION

Application of aluminum alloys and other light metals and high-strength steel sheets to automobile members has expanded for the purpose of reducing automobile weight, and thereby reducing fuel consumption and other related advantages. However, while light metals such as aluminum alloys have an advantage of high specific strength, their application is limited to special uses because they are far more costly than steel. To further reduce automobile weight, a wider application of low cost, high-strength steel sheets has been highly recommended.

However, when a bending deformation procedure is applied to a work piece of a high-strength steel sheet, because of the high strength thereof, the shape of the work piece thereafter tends to deviate from the shape of the forming jig, and may return to its original shape. The phenomenon of the shape after working of a work piece returning to its original shape is called a "spring back". When spring back occurs, an envisaged shape is not obtained in the work piece. For this reason, high-strength steel sheets used for conventional automobile bodies have mostly been limited to those having a strength up to 440 MPa.

Although it is preferable to further reduce the weight of a car body by the use of a high-strength steel sheet having a high strength of 490 MPa or more, a high-strength steel sheet showing small spring back and having a good shape fixation property has generally not been available. To enhance the shape fixation property after the working of a high-strength steel sheet having a strength up to 440 MPa or a sheet of a mild steel is generally important for improving the shape accuracy of products such as automobiles and electric home appliances.

Japanese Patent Publication No. H10-72644 describes a cold-rolled austenitic stainless steel sheet having a small amount of spring back (referred to as a dimensional accuracy in the present invention). This publication describes that the convergence of a {200} texture in a plane parallel to the rolled surfaces is 1.5 or more. However, the publication may not include the description related to a technology for reducing the phenomena of the spring back and/or the wall warping of a ferritic steel sheet.

Japanese Patent Publication No. 2001-32050 discloses an invention wherein the reflected X-ray strength ratio of a {100} plane parallel to the sheet surfaces is controlled to 2 or more in the texture at the center of the sheet thickness, and provides certain information regarding the technology for reducing the amount of spring back of a ferritic stainless steel sheet. However, this publication does not refer to the reduction of wall warping and does not include a specification regarding the orientation component group of {100}<011> to {223}<110> and the orientation component {112}<110>, which is an important orientation component for reducing the wall warping.

International Patent Publication No. WO 00/06791 describes a ferritic thin steel sheet whose ratio of reflected X-ray strength of a {100} plane to that of a {111} plane is controlled to 1 or more for the purpose of improving the shape fixation property. However, this publication does not describe the ratios of the X-ray strength in the orientation component group of {100}<011> to {223}<110> to the random X-ray diffraction strength and those in the orientation components of {554}<225>, {111}<112> and {111}<110> to the random X-ray diffraction strength. In addition, there is no disclosure in this International publication of a technology for improving drawability.

Japanese Patent Publication No. 2001-64750 describes a cold-rolled steel sheet, in which, as a technology for reducing the amount of spring back, the reflected X-ray strength ratio of a {100} plane parallel to sheet surfaces is controlled to 3 or more. This publication describes the reflected X-ray strength ratio of a {100} plane on a surface of a steel sheet, and provides that the position of X-ray measurement is different from the position specified in the present invention. In particular, the average X-ray strength ratio in the orientation component group of {100}<011> to {223}<110> is measured at the center of the thickness of a steel sheet. In addition, this publication does not refer to the orientation components of {554}<225>, {111}<112> and {111}<110>, and does not describe the technology for improving drawability.

Further, Japanese Patent Publication No. 2000-297349 describes a hot-rolled steel sheet a steel sheet excellent in a shape fixation property, whereas the absolute value of the in-plane anisotropy of r-value $\Delta r$ is controlled to 0.2 or less. However, this publication describes improving a shape fixation property by lowering a yield ratio, and it does not include a description regarding the control of a texture aiming at improving a shape fixation property.

SUMMARY OF THE INVENTION

One of the objects of the present invention is to provide a high-strength thin steel sheet excellent in a shape fixation property and drawability, and a method of producing said steel sheet economically and stably. The present invention relates to a high-strength thin steel sheet drawable and excellent in a shape fixation property for obtaining a good drawability even with a steel sheet which may have a texture disadvantageous for drawing work, and a method of producing the same.

In consideration of the production processes of high-strength thin steel sheets presently produced on an industrial scale using generally employed production facilities, an investigation of how to obtain a high-strength thin steel sheet having both a good shape fixation property and a high drawability simultaneously has been performed.

Accordingly, the present invention may be preferably based on the following conditions are very effective for securing both a good shape fixation property and a high drawability at the same time: at least on a plane at the center of the thickness of a steel sheet, the average ratio of the X-ray strength in the orientation component group of {100}<011> to {223}<110> to random X-ray diffraction strength is 3.0 or more and the average ratio of the X-ray strength in the three orientation components of {554}<225>, {111}<112> and {111}<110> to random X-ray diffraction strength is 3.5 or less; a composition having a lubricating effect is applied to a steel sheet wherein an arithmetic average of roughness Ra of at least one of the surfaces is 1 to 3.5 μm; and the friction coefficient of the steel sheet surfaces at 0 to 200° C. is 0.05 to 0.2.

According to one exemplary embodiment of the present invention, a high-strength thin steel sheet drawable and excellent in a shape fixation property is provided. The sheet includes at least on a plane at the center of the thickness of a steel sheet, the average ratio of the X-ray strength in the orientation component group of {100}<011> to {223}<110> to random X-ray diffraction strength is 3 or more and the average ratio of the X-ray strength in three orientation components of {554}<225>, {111}<112> and {111}<110> to random X-ray diffraction strength is 3.5 or less; the arithmetic average of the roughness Ra of at least one of the surfaces is 1 to 3.5 μm; and the surfaces of the steel sheet are covered with a composition having a lubricating effect.

In addition, the friction coefficient of the steel sheet surfaces at 0 to 200° C. may be 0.05 to 0.2. The microstructure of the steel sheet may be a compound structure containing ferrite as the phase accounting for the largest volume percentage and martensite mainly as the second phase. In addition, the microstructure of the steel sheet may be a compound structure containing retained austenite by 5 to 25% in terms of volume percentage and having the balance mainly consisting of ferrite and bainite. Further, the microstructure of the steel sheet can be a compound structure containing bainite or ferrite and bainite as the phase accounting for the largest volume percentage.

According to another exemplary embodiment of the present invention, the steel sheet contains, in mass, C: 0.01 to 0.3%, Si: 0.01 to 2%, Mn: 0.05 to 3%, P: 0.1% or less, S: 0.01% or less, and Al: 0.005 to 1%, with the balance consisting of Fe and unavoidable impurities.

According to still another exemplary embodiment of the present invention, the steel sheet contains, in mass, Ti: 0.05 to 0.5% and/or Nb: 0.01 to 0.5%.

According to yet another exemplary embodiment of the present invention, the steel sheet contains, in mass, C: 0.01 to 0.1%, S: 0.03% or less, N: 0.005% or less, and Ti: 0.05 to 0.5%, so as to satisfy the following expression:

$$Ti-(48/12)C-(48/14)N-(48/32)S \geqq 0\%,$$

with the balance consisting of Fe and unavoidable impurities.

Further, the steel sheet may contain, in mass,

Nb: 0.01 to 0.5%, and

Ti, so as to satisfy the following expression:

$$Ti+(48/93)Nb-(48/12)C-(48/14)N-(48/32)S \geqq 0\%,$$

with the balance consisting of Fe and unavoidable impurities.

In addition, the steel sheet can contain, in mass,

Si: 0.01 to 2%,

Mn: 0.05 to 3%,

P: 0.1% or less, and

Al: 0.005 to 1%.

According to still another embodiment of the present invention, the steel sheet may further contain, in mass, B: 0.0002 to 0.002%, Cu: 0.2 to 2%, Ni: 0.1 to 1%, Ca: 0.0005 to 0.002% and/or REM: 0.0005 to 0.02%, Mo: 0.05 to 1%, V: 0.02 to 0.2%, Cr: 0.01 to 1%, and/or Zr: 0.02 to 0.2%.

An arrangement according to yet another exemplary embodiment of the present invention provides a zinc plating layer between the steel sheet and a composition having a lubricating effect.

A method of producing a high-strength thin steel sheet drawable and excellent in a shape fixation property according to the present invention is also provided. Particularly, in a hot rolling process for obtaining the steel sheet, a slab having said chemical components is subjected to rough rolling. Then, the slab is finish rolled at a total reduction ratio of 25% or more in terms of steel sheet thickness in the temperature range of the $Ar_3$ transformation temperature +100° C. or lower. Thereafter, a composition having a lubricating effect is applied to the surfaces of the steel sheet.

In addition, a slab having said chemical components may be subjected to rough rolling. Then, to finish rolling at a total reduction ratio of 25% or more in terms of steel sheet thickness in the temperature range of the $Ar_3$ transformation temperature +100° C. or lower, the hot-rolled steel sheet thus produced may be retained for 1 to 20 sec. in the temperature range from the $Ar_1$ transformation temperature to the $Ar_3$ transformation temperature. Then, the steel sheet can be cooled at a cooling rate of 20° C./sec. or more, and it is coiling at a coiling temperature of 350° C. or lower. Thereafter, a composition having a lubricating effect is applied to the surfaces of the steel sheet.

According to yet another exemplary embodiment of the method of the present invention, a slab having said chemical components may be subjected to rough rolling. Then, to finish rolling at a total reduction ratio of 25% or more in terms of steel sheet thickness in the temperature range of the $Ar_3$ transformation temperature +100° C. or lower, the hot-rolled steel sheet thus produced is retained for 1 to 20 sec. in the temperature range from the $Ar_1$ transformation temperature to the $Ar_3$ transformation temperature. Then, such sheet is cooled at a cooling rate of 20° C./sec. or more, and it is coiled at a coiling temperature in the range from over 350° C. to below 450° C.; and, thereafter, applying a composition having a lubricating effect to the surfaces of the steel sheet. The steel sheet can also be cooled at a cooling rate of 20° C./sec. or more, and coiling it at a coiling temperature of 450° C. or more, and, thereafter, a composition having a lubricating effect can be applied to the surfaces of the steel sheet.

In a still another exemplary embodiment of the method according to the present invention, a slab having said chemical components is subjected to rough rolling. Then, the sheet is finish rolled at a total reduction ratio of 25% or more in terms of steel sheet thickness in the temperature range of the $Ar_3$ transformation temperature +100° C. or lower. The sheet is cooled and coiled the steel sheet thus produced, and, thereafter, a composition having a lubricating effect is applied. Further, in a hot rolling process, a lubrication rolling is applied to the finish rolling after a rough rolling procedure. In addition, a descaling procedure may be applied after the completion of the rough rolling procedure.

According to another exemplary embodiment of the method of the present invention, a slab having said chemical components is subject to, sequentially, hot rolling, pickling, cold rolling at a reduction ratio below 80% in terms of steel sheet thickness. Then, a heat treatment is applied comprising the processes of retaining the cold-rolled steel sheet for 5 to 150 sec. in the temperature range from the recovery temperature to the $Ac_3$ transformation temperature +100° C. Then, the slab is cooled, and thereafter, a composition having a lubricating effect is applied to the surfaces of the steel sheet.

According to a further exemplary embodiment of a method for producing a high-strength thin steel sheet drawable and excellent in a shape fixation property according of the present invention, a slab having specific chemical components is subjected to, sequentially, hot rolling, pickling, cold rolling at a reduction ratio below 80% in terms of steel sheet thickness. Then, a heat treatment is applied comprising the processes of retaining the cold-rolled steel sheet for 5 to 150 sec. in the temperature range from the $Ac_1$ transformation temperature to the $Ac_3$ transformation temperature +100° C. Then, the slab is cooled at a cooling rate of 20° C./sec. or more to the temperature range of 350° C. or lower, and, thereafter a composition having a lubricating effect is applied to the surfaces of the steel sheet. In another exemplary embodiment, the slab is cooled at a cooling rate of 20° C./sec. or more to the temperature range from above 350° C. to below 450° C., and it is retained again in this temperature range for 5 to 600 sec. Then, the slab is cooled again at a cooling rate of 5° C./sec. or more to the temperature range of 200° C. or lower, and thereafter, the composition having a lubricating effect is applied to the surfaces of the steel sheet.

In another exemplary embodiment of the method according to the present invention for producing a high-strength thin steel sheet drawable and excellent in a shape fixation property, a slab having said chemical components is subjected to sequentially hot rolling, pickling, cold rolling at a reduction ratio below 80% in terms of steel sheet thickness. Then, a heat treatment is applied comprising the processes of retaining the cold-rolled steel sheet for 5 to 150 sec. in the temperature range from the $Ac_1$ transformation temperature to the $Ac_3$ transformation temperature +100° C. and then cooling it; and, thereafter, applying a composition having a lubricating effect to the surfaces of the steel sheet.

In addition, an exemplary embodiment of a method for producing a high-strength thin steel sheet drawable and excellent in a shape fixation property includes subjecting a slab having said chemical components to sequentially hot rolling, pickling, cold rolling at a reduction ratio below 80% in terms of steel sheet thickness, then applying a heat treatment comprising the processes of retaining the cold-rolled steel sheet for 5 to 150 sec. in the temperature range from the recovery temperature to the $Ac_3$ transformation temperature +100° C. and then cooling it; and, thereafter, applying a composition having a lubricating effect. In addition, the surfaces of the steel sheet can be galvanized by dipping the steel sheet in a zinc plating bath after hot rolling. Thereafter, the composition having a lubricating effect is applied to the surfaces of the steel sheet. Alternatively or in addition, the surfaces of the steel sheet may be galvanized by dipping the steel sheet in a zinc plating bath after the completion of the heat treatment processes.

All references and publications referred to above are incorporated herein by reference in their entireties.

DETAILED DESCRIPTION

Figure 1:
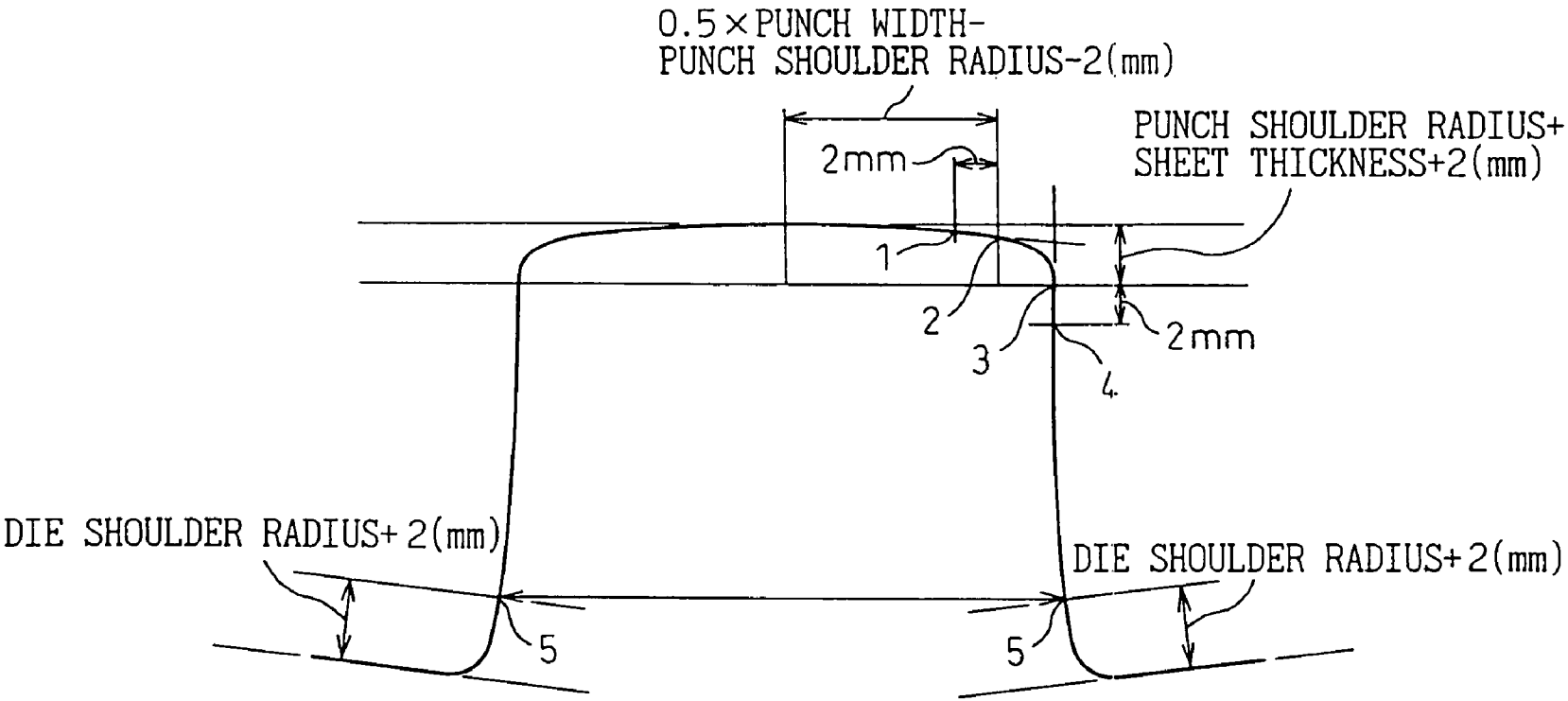
FIG. 1 is a schematic illustration showing a sectional shape of a sample having undergone a bending test according to the present invention.

For realizing an excellent shape fixation property, it is preferable that the average of the ratio of the X-ray strength in the orientation component group of {100}<011> to {223}<110> to random X-ray diffraction strength on a plane at the center of the thickness of a steel sheet be 3 or more. If such average ratio is below 3, the shape fixation property may become poor.

The average ratio of the X-ray strength in the orientation component group of {100}<011> to {223}<110> to random X-ray diffraction strength may be obtained from the three-dimensional texture obtained by calculating the X-ray diffraction strengths in the principal orientation components included in the orientation component group, namely {100}<011>, {116}<110>, {114}<110>, {113}<110>, {112}<110>, {335}<110> and {223}<110>, either by the vector method based on the pole figure of {110}, or by the series expansion method using two or more (desirably, three or more) pole figures out of the pole figures of {110}, {100}, {211} and {310}.

For example, as the ratio of the X-ray strength in the above crystal orientation components to random X-ray diffraction strength calculated by the latter method, the strengths of (001)[1-10], (116)[1-10], (114)[1-10], (113)[1-10], (112)[1-10], (335)[1-10] and (223)[1-10] at a $\phi 2=45°$ cross section in a three-dimensional texture can be used without modification. The average ratio of the X-ray strength in the orientation component group of {100}<011> to {223}<110> to random X-ray diffraction strength is preferably the arithmetic average ratio of all the above orientation components. When it is unlikely to obtain the strengths in all these orientation components, the arithmetic average of the strengths in the orientation components of {100}<011>, {116}<110>, {114}<110>, {112}<110> and {223}<110> may be used as a substitute.

In addition to the above, it is preferable that the average ratio of the X-ray strength in the following three orientation components, namely {554}<225>, {111}<112> and {111}<110>, to random X-ray diffraction strength be 3.5 or less. When it exceeds 3.5, even if the average ratio of the X-ray strength in the orientation component group of {100}<011> to {223}<110> to random X-ray diffraction strength is within the appropriate range, a good shape fixation property is not obtained. In such case, the average ratio of the X-ray strength in the three orientation components of {554}<225>, {11}<112> and {111}<110> to random X-ray diffraction strength can be calculated from the three-dimensional texture obtained in the same manner as explained above. It is preferable in the present invention that the average ratio of the X-ray strength in the orientation component group of {100}<011> to {223}<110> to random X-ray diffraction strength be 4 or more, and that the arithmetic average ratio of the X-ray strength in the orientation components of {554}<225>, {111}<112> and {111}<110> to random X-ray diffraction strength be below 2.5.

The reason why the X-ray strengths in the crystal orientation components are important for a shape fixation property in bending work may be due to, at least in part, the sliding behavior of crystals during bending deformation.

A specimen for an X-ray diffraction measurement may be prepared by cutting out a test piece 30 mm in diameter from a position of ¼ or ¾ of the width of a steel sheet, grinding the surfaces up to the three-triangle grade finish (the second finest finish) and, then, removing strain by chemical polishing or electrolytic polishing. A crystal orientation component expressed as {hkl}<uvw> means that the direction of a normal to the plane of a steel sheet is parallel to <hkl> and the rolling direction of the steel sheet is parallel to <uvw>. The measurement of a crystal orientation with X-ray is conducted, for example, in accordance with the method described in pages 274 to 296 of the Japanese translation of Elements of X-ray Diffraction by B. D. Cullity (published in 1986 from AGNE Gijutsu Center, translated by Gentaro Matsumura).

Next, the surface conditions of a steel sheet, which may be important in the present invention for securing good drawability, are explained. According to an exemplary embodiment of the present invention, the arithmetic average of roughness Ra of at least one of the surfaces of a steel sheet before the steel sheet may be coated with a composition having a lubricating effect is determined to be from 1 to 3.5 μm. When the arithmetic average of roughness Ra is below 1 μm, it becomes difficult to retain on the steel sheet surface a composition having a lubricating effect to be applied later. When the arithmetic average of roughness Ra exceeds 3.5 μm, on the other hand, a sufficient lubricating effect cannot be obtained even after a composition having a lubricating effect is applied. For this reason, the arithmetic average of roughness Ra of at least one of the surfaces of a steel sheet is determined to be from 1 to 3.5 μm. A preferable range is from 1 to 3 μm. In this case, the arithmetic average of roughness Ra is an arithmetic average of roughness Ra specified in Japanese Industrial Standard (JIS) B 0601-1994.

In addition to the above, according to the present invention, the friction coefficient of a steel sheet after the application of a composition having a lubricating effect can be determined to be 0.05 to 0.2 at 0 to 200° C. in the direction of rolling and/or in the direction perpendicular to the rolling direction. When a friction coefficient is below 0.05, even if blank holding force (BHF) is increased during press forming for improving a shape fixation property, a steel sheet is not held at its brim and the material flows into a die, deteriorating the shape fixation property. When a friction coefficient exceeds 0.2, on the other hand, the flow of a steel sheet into a die is decreased even if the BHF is lowered within a practical tolerance, probably leading to the deterioration of drawing workability. For this reason, the friction coefficient of at least one of the directions must be 0.05 to 0.2.

As for the temperature range in which the value of a friction coefficient is prescribed, if a friction coefficient is measured at below 0° C., an adequate evaluation is impossible because of frost, etc. forming on a steel sheet surface. If the temperature is above 200° C., a composition having a lubricating effect applied to the surfaces of a steel sheet may become unstable. For this reason, the temperature range in which the value of a friction coefficient is prescribed may be determined to be from 0 to 200° C.

A friction coefficient can be defined as the ratio (f/F) of a drawing force (f) to a pressing force (F) in the following test procedures: a composition having a lubricating effect is applied to the surfaces of a subject steel sheet to be evaluated; the steel sheet is placed between two flat plates having a Vickers hardness of Hv600 or more at the surfaces; a force (F) perpendicular to the surfaces of the subject steel sheet is imposed so that the contact stress is 1.5 to 2 kgf/mm$^2$; and the force (f) preferable for pulling out the subject steel sheet from between the flat plates is measured.

Then, an index of drawability of a steel sheet is defined as the quotient (D/d) obtained by dividing the maximum diameter (D) in which drawing has been successful by the diameter (d) of a cylindrical punch when a steel sheet is formed into a disc-shape and subjected to drawing work using the cylindrical punch. In this example, steel sheets may be formed into various disc-shapes 300 to 400 mm in diameter and a cylindrical punch 175 mm in diameter having a shoulder 10 mm in radius around the bottom face and a die having a shoulder 15 mm in radius are used in the evaluation of drawability.

Exemplary microstructure of a steel sheet according to the present invention are described herein below.

According to another exemplary embodiment of the present invention, it is not necessary to specify the microstructure of a steel sheet for the purpose of improving a shape fixation property; the effect of the present invention for improving a shape fixation property is obtained as far as a texture falling within the range of the present invention (the ratios of the X-ray strength in specific orientation components to random X-ray diffraction strength within the ranges of the present invention) is obtained in the structures of ferrite, bainite, pearlite and/or martensite formed in commonly used steel materials. Further, stretch formability and other press forming properties can be enhanced, when a specific microstructure, for example, a compound structure containing retained austenite by 5 to 25% in terms of volume percentage and having the balance mainly consisting of ferrite and bainite, a compound structure containing ferrite as the phase accounting for the largest volume percentage and martensite mainly as the second phase, or the like, is formed.

When a structure which is not a bcc crystal structure, such as retained austenite, may be included in a compound structure composed of two or more phases, such a compound structure does not pose any problem insofar as the ratios of the X-ray strength in the orientation components and orientation component groups to random X-ray diffraction strength converted by the volume percentage of the other structures are within the respective ranges of the present invention.

Besides, pearlite containing coarse carbides may act as a starting point of a fatigue crack, remarkably deteriorating fatigue strength, and, for this reason, it is desirable that the volume percentage of the pearlite containing coarse carbides be 15% or less. When further additional fatigue properties are preferred, it may be desirable that the volume percentage of the pearlite containing coarse carbides be 5% or less.

In such manner, the volume percentage of ferrite, bainite, pearlite, martensite or retained austenite is defined as the area percentage in a microstructure at a position in the depth of ¼ of the steel sheet thickness, obtained by: polishing a test piece, which can be cut out from a position of ¼ or ¾ of the width of a steel sheet, along the section surface in the rolling direction; etching the section surface with nitral reagent and/or the reagent as described in Japanese Patent Publication No. H5-163590. Then, the etched surface is observed with a light-optical microscope under a magnification of 200 to 500. Since it may sometimes be difficult to identify retained austenite by the etching with the above reagents, the volume percentage may be calculated in the following manner.

Because the crystal structure of austenite is different from that of ferrite, they can be distinguished crystallographically. Therefore, the volume percentage of retained austenite can be obtained by the X-ray diffraction method too, for example, by the simplified method of calculating the volume percentage by the following equation based on the difference between austenite and ferrite in the reflection intensity of their lattice planes using the κα ray of Mo:

$$V\gamma=(2/3)\{100/(0.7\times\alpha(211)/\gamma(220)+1)\}+(1/3)\{100/(0.78\times\alpha(211)/\gamma(311)+1)\},$$

where, α(211), γ(220) and γ(311) are the X-ray reflection intensity values of the indicated lattice planes of ferrite (α) and austenite (γ), respectively.

In order to obtain a low yield ratio for realizing a better shape fixation property than the once improved shape fixation property in the present invention, it is preferable that the microstructure of a steel sheet is a compound structure containing ferrite as the phase accounting for the largest volume percentage and martensite mainly as the second phase. The exemplary embodiment of the present invention allows the sheet to contain unavoidably included bainite, retained austenite and pearlite if their total percentage is below 5%. For securing a low yield ratio of 70% or less, it may be desirable that the volume percentage of ferrite be 50% or more.

In order to obtain a good ductility, in addition to improving a shape fixation property, in the present invention, it is preferable that the microstructure of a steel sheet is a compound structure containing retained austenite by 5% to 25% in terms of volume percentage and having the balance mainly consisting of ferrite and bainite. The exemplary embodiment of the present invention allows the sheet to also contain unavoidably included martensite and pearlite if their total percentage is below 5%.

Further, in order to obtain a good burring workability, in addition to improving a shape fixation property, according to the exemplary embodiment of the present invention, it is preferable that the microstructure of a steel sheet is a compound structure containing bainite or ferrite and bainite as the phase accounting for the largest volume percentage. In such manner, the exemplary embodiment of the present invention allows the sheet to contain unavoidably included martensite, retained austenite and pearlite. In order to obtain a good burring workability (a hole expansion ratio), it is desirable that the total volume percentage of hard retained austenite and martensite be below 5%. It is also desirable that the volume percentage of bainite be 30% or more. Further, for realizing a good ductility, it is desirable that the volume percentage of bainite be 70% or less.

In order to obtain a better burring workability, in addition to improving a shape fixation property, according to yet another exemplary embodiment of the present invention, it is desirable that the microstructure of a steel sheet consists of a single phase of ferrite for securing a good burring workability (a hole expansibility). The exemplary embodiment of the present invention allows some amount of bainite to be contained. Further, in order to secure a yet better burring workability, it is desirable that the volume percentage of bainite be 10% or less. In such manner, the present invention allows containing unavoidably included martensite, retained austenite and pearlite. The ferrite mentioned here includes bainitic ferrite and acicular ferrite structures. Further, in order to secure good fatigue properties, it is desirable that the volume percentage of pearlite containing coarse carbides be 5% or less. Additionally, in order to secure a good burring workability (a hole expansibility), it is desirable that the total volume percentage of retained austenite and martensite be below 5%.

Next, the exemplary chemical components of the present invention are explained.

C is a preferable element for obtaining a desired microstructure. When C content exceeds 0.3%, however, workability is deteriorated and, for this reason, the content is set at 0.3% or less. Additionally, when C content exceeds 0.2%, weldability is deteriorated and, for this reason, it is desirable that the content be 0.2% or less. On the other hand, when the content of C is below 0.01%, steel strength decreases and, therefore, the content is set at 0.01% or more. Further, in order to obtain retained austenite stably in an amount sufficient for realizing a good ductility, it is desirable that the content be 0.05% or more.

In addition, when the content of C exceeds 0.1%, workability and weldability are deteriorated, and, therefore, the content is set at 0.1% or less. When the content is below 0.01%, steel strength is lowered and, for this reason, its content is set at 0.01% or more.

Si is a solute strengthening element and, as such, it is effective for enhancing strength. Its content has to be 0.01% or more for obtaining a desired strength but, when it is contained in excess of 2%, workability is deteriorated. The Si content, therefore, is determined to be from 0.01 to 2%.

Mn is a solute strengthening element and, as such, it is effective for enhancing strength. Its content has to be 0.05% or more for obtaining a desired strength. In the case where elements such as Ti, which suppress the occurrence of hot cracking induced by S, are not added in a sufficient amount in addition to Mn, it is desirable to add Mn so that the expression $Mn/S \geqq 20$ is satisfied in terms of mass percentage. Further, Mn is an element to stabilize austenite and, therefore, in order to stably obtain a sufficient amount of retained austenite for realizing a good ductility, it is desirable that its addition amount be 0.1% or more. When Mn is added in excess of 3%, on the other hand, cracks occur to slabs. Thus, the content is set at 3% or less.

P is an undesirable impurity, and the lower its content the better. When the content exceeds 0.1%, workability and weldability are adversely affected, and so are fatigue properties. Therefore, P content is set at 0.1% or less.

S causes cracks to occur during hot rolling when contained too much and, therefore, the content must be controlled as low as possible, but the content up to 0.03% is permissible. S is also an impurity and the lower its content the better. When S content is too large, the A type inclusions detrimental to local ductility and burring workability are formed and, for this reason, the content has to be minimized. A desirable content of S is, therefore, 0.01% or less.

Al is preferable to be added by 0.005% or more for deoxidizing molten steel, but its upper limit is set at 1.0% for avoiding cost increase. Al increases the formation of nonmetallic inclusions and deteriorates elongation when added excessively and, for this reason, a desirable content of Al is 0.5% or less.

N combines with Ti and Nb and forms precipitates at a temperature higher than C does, and, by so doing, decreases the amounts of Ti and Nb which are effective for fixing C. For this reason, N content should be minimized. A permissible content of N is 0.005% or less.

Ti contributes to the increase of the strength of a steel sheet through precipitation strengthening. When the content is below 0.05%, however, the effect is insufficient and, when the content exceeds 0.5%, not only the effect is saturated but also the cost of alloy addition is increased. For this reason, the content of Ti is determined to be from 0.05 to 0.5%.

In addition, Ti is one of the important elements in certain exemplary embodiments of the present invention. To precipitate and fix C, which forms carbides such as cementite detrimental to burring workability, and thereby contribute to the improvement of burring workability, it is preferable that the condition, Ti−(48/12)C−(48/14)N−(48/32)S>0%, be satisfied.

In such manner, since S and N combine with Ti to form precipitates at a temperature comparatively higher than C does, in order to satisfy the expression Ti≧48/12C, the condition, Ti−(48/12)C−(48/14)N−(48/32)S>0%, should be satisfied.

Nb contributes to the improvement of the strength of a steel sheet through precipitation strengthening, like Ti does. It also has an effect to improve burring workability by making crystal grains fine. When the content is below 0.01%, however, the effects do not show up sufficiently and, if the content exceeds 0.5%, not only the effects are saturated but also the cost of alloy addition is increased. For this reason, the content of Nb is determined to be from 0.01 to 0.5%.

Further, in order to precipitate and fix C, which forms carbides such as cementite detrimental to burring workability, and thereby contribute to the improvement of burring workability, it is preferable that the condition, Ti+(48/93)Nb−(48/12)C−(48/14)N−(48/32)S≧0%, be satisfied.

In such manner, since Nb forms carbides at a temperature comparatively lower than Ti does, in order to satisfy the expression Ti+48/93Nb>48/12C, the condition, Ti+(48/93)Nb−(48/12)C−(48/14)N−(48/32)S≧0%, must be satisfied inevitably.

Cu can be added as needed, since it has an effect to improve fatigue properties when it is in the state of solid solution. However, a tangible effect is generally not obtained when the addition amount is below 0.2%, but the effect is saturated when the content exceeds 2%. Thus, the range of the Cu content is determined to be from 0.2 to 2%. It has to be noted that, when the coiling temperature is 450° C. or higher, if Cu is contained in excess of 1.2%, it may precipitate after coiling, drastically deteriorating workability. For this reason, it is desirable that the content of Cu be limited to 1.2% or less.

B may be added as needed, since it has an effect to raise fatigue limit when added in combination with Cu. Further, B can be added, since it has an effect to raise fatigue limit by suppressing the intergranular embrittlement caused by P, which is considered to result from a decrease in the amount of solute C. An addition of B by below 0.0002% is generally not enough for obtaining the effects but, when B is added in excess of 0.002%, cracks may occur to a slab. For this reason, the addition amount of B is preferably determined to be from 0.0002 to 0.002%.

Ni can be added as needed for preventing hot shortness caused by containing Cu. An addition amount of below 0.1% is not enough for obtaining the effect but, when Ni is added in excess of 1%, the effect is saturated. For this reason, the content is determined to be from 0.1 to 1%. When the content of Cu is 1.2% or less, it is desirable that the content of Ni be 0.6% or less.

Ca and REM are the elements to modify the shape of non-metallic inclusions, which serve as starting points of fractures and/or deteriorate workability, and to render them harmless. But a tangible effect is not obtained when either of them is added by below 0.0005%. When Ca is added in excess of 0.002% or REM in excess of 0.02%, the effect is saturated. Thus, it is desirable to add Ca by 0.0005 to 0.002% and REM by 0.0005 to 0.02%.

Additionally, one or more of precipitation strengthening elements and solute strengthening elements, namely Mo, V, Cr and Zr, may be added for enhancing strength. However, when they are added by below 0.05%, 0.02%, 0.01% and 0.02%, respectively, no tangible effects show up and, when they are added in excess of 1%, 0.2%, 1% and 0.2%, respectively, the effects are saturated.

Sn, Co, Zn, W and/or Mg may be added by 1% or less in total to a steel mainly consisting of the components explained above, but, since Sn may cause surface defects during hot rolling, it is preferable to limit the content of Sn to 0.05% or less.

Now, the reasons for limiting the conditions of the production method according to the present invention are hereafter described in detail.

A steel sheet according to the present invention can be produced through the processes of: casting; hot rolling and cooling, or hot rolling, cooling, pickling and cold rolling; then, heat treatment or heat treatment of a hot-rolled or cold-rolled steel sheet in a hot dip plating line; and further surface treatment applied to a steel sheet thus produced separately as occasion demands.

The present invention does not require specific production methods prior to hot rolling. In particular, a steel may be melted and refined by a blast furnace, an electric arc furnace or the like; then the chemical components may be adjusted so as to contain desired amounts of the components in one or more of various secondary refining processes; and then the steel may be cast into a slab through a casting process such as an ordinary continuous casting process, an ingot casting process and a thin slab casting process. Steel scraps may be used as a raw material. Further, in the case of a slab cast through a continuous casting process, the slab may be fed to a hot-rolling mill directly while it is hot, or after cooling it to the room temperature and then heating it in a reheating furnace.

No specific limit is particularly set to the temperature of reheating, but it is desirable that a reheating temperature be below 1,400° C. since, when it is 1,400° C. or higher, the amount of scale off becomes large and the product yield is lowered. It is also desirable that a reheating temperature be 1,000° C. or higher since a reheating temperature of below 1,000° C. remarkably lowers the operation efficiency of the mill in the rolling schedule. Further, it is desirable that a reheating temperature be 1,100° C. or higher, because, when the reheating temperature is below 1,100° C., not only precipitates containing Ti and/or Nb coarsen without remelting in a slab and thus their precipitation strengthening capacity is lost, but also precipitates containing Ti and/or Nb having a size and a distribution desirable for improving burring workability do not precipitate.

In a hot rolling process, a slab undergoes finish rolling after completing rough rolling. When descaling is applied after completing rough rolling, it is desirable that the following condition be satisfied:

$$P(\mathrm{MPa})\times L(\mathrm{l/cm^2})\geqq 0.0025,$$

where P (MPa) is an impact pressure of high-pressure water on a steel sheet surface, and L (l/cm$^2$) is a flow rate of descaling water.

An impact pressure P of high-pressure water on a steel sheet surface is expressed as follows (see Tetsu-to-Hagane, 1991, Vol. 77, No. 9, p. 1450):

$$P(\mathrm{MPa})=5.64\times PO\times V\times H^2,$$

where, PO (MPa) is a pressure of liquid, V (l/min.) is a liquid flow rate of a nozzle, and H (cm) is a distance between a nozzle and the surface of a steel sheet.

The flow rate L (l/cm$^2$) is expressed as follows:

$$L(\mathrm{l/cm^2})=V/(W\times v)$$

where, V (l/min.) is a liquid flow rate of a nozzle, W (cm) is the width where the liquid blown from a nozzle hits a steel sheet surface, and v (cm/min.) is a travelling speed of a steel sheet.

For obtaining certain effects of the present invention, it is not necessary to particularly set an upper limit to the product of the impact pressure P and the flow rate L, but it is preferable that the product be 0.02 or less because, when the liquid flow rate of a nozzle is raised, troubles such as the increased wear of the nozzle occur.

It is preferable, further, that the maximum roughness height Ry of a steel sheet after finish rolling be 15 μm (we define as 15 μmRy, This is a result when the standard length l is 2.5 mm and the length of evaluation ln is 12.5 mm applied to the method described in p5-p7 of JIS B 0601-1994.) or less. The reason for this is clear from the fact that the fatigue strength of a steel sheet as hot-rolled or as pickled correlates with the maximum roughness height Ry of the steel sheet surface, as stated in page 84 of Metal Material Fatigue Design Handbook edited by the Society of Materials Science, Japan, for example. Further, it is preferable that the finish hot rolling be done within 5 sec. after high pressure descaling, in order to prevent scales from forming again.

In addition, in order to realize an effect to lower a friction coefficient by applying a composition having a lubricating effect, it is desirable that the arithmetic average of roughness Ra of the surface of a steel sheet after finish rolling be 3.5 or less, unless the steel sheet is subjected to skin pass rolling or cold rolling after hot rolling or pickling.

Besides the above, the finish rolling may be conducted continuously by welding sheet bars together after rough rolling or the subsequent descaling. In this case, the rough-rolled sheet bars may be welded together after being coiled temporarily, held inside a cover having a heat retention function, as occasion demands, and then uncoiled.

When a hot-rolled steel sheet is used as a final product, it is preferable that the finish rolling be done at a total reduction ratio of 25% or more in the temperature range of the $Ar_3$ transformation temperature +100° C. or lower during the latter half of the finish rolling. In this manner, the $Ar_3$ transformation temperature can be expressed in relation to the steel chemical components, in a simplified manner, by the following equation, for instance:

$$Ar_3=910-310\times\%\ C+25\times\%\ Si-80\times\%\ Mn.$$

When the total reduction ratio in the temperature range of the $Ar_3$ transformation temperature +100° C. or lower is less than 25%, the rolled austenite texture does not develop sufficiently and, as a result, the effects of the present invention are not obtained, no matter how the steel sheet is cooled thereafter. For obtaining a sharper texture, it is desirable that the total reduction ratio in the temperature range of the $Ar_3$ transformation temperature +100° C. or lower be 35% or more.

The present invention does not particularly specify a lower limit of the temperature range when the rolling of a total reduction ratio of 25% or more is carried out. However, when the rolling is done at a temperature below the $Ar_3$ transformation temperature, a work-induced structure remains in ferrite having precipitated during the rolling, and, as a result, ductility is lowered and workability is deteriorated. For this reason, it is desirable that the lower limit of the temperature range when the rolling of a total reduction ratio of 25% or more is carried out be equal to or higher than the $Ar_3$ transformation temperature. However, if recovery or recrystallization is to be advanced to some extent during the subsequent coiling process or a heat treatment after the coiling process, a temperature below the $Ar_3$ transformation temperature is acceptable.

The present invention does not particularly specify an upper limit of the total reduction ratio in the temperature range of the $Ar_3$ transformation temperature +100° C. or lower. However, when the total reduction ratio exceeds 97.5%, the rolling load becomes too high and it becomes preferable to increase the rigidity of the mill excessively, resulting in economical disadvantage. For this reason, the total reduction ratio is, desirably, 97.5% or less.

In such manner, when the friction between a hot-rolling roll and a steel sheet is large during hot rolling in the temperature range of the $Ar_3$ transformation temperature +100° C. or lower, crystal orientations mainly composed of {110} develop at planes near the surfaces of a steel sheet, causing the deterioration of a shape fixation property. As a countermeasure, lubrication is applied, as occasion demands, for reducing the friction between a hot-rolling roll and a steel sheet.

The present invention does not particularly specify an upper limit of the friction coefficient between a hot-rolling roll and a steel sheet. However, when it exceeds 0.2, crystal orientations mainly composed of {110} develop conspicuously, deteriorating a shape fixation property. For this reason, it is desirable to control the friction coefficient between a hot-rolling roll and a steel sheet to 0.2 or less at least at one of the passes of the hot rolling in the temperature range of the $Ar_3$ transformation temperature +100° C. or lower. It is preferable yet to control the friction coefficient between a hot-rolling roll and a steel sheet to 0.15 or less at all the passes of the hot rolling in the temperature range of the $Ar_3$ transformation temperature +100° C. or lower. In such manner, the friction coefficient between a hot-rolling roll and a steel sheet is the value calculated from a forward slip ratio, a rolling load, a rolling torque and so on based on the rolling theory.

The present invention does not particularly specify the temperature at the final pass (FT) of a finish rolling, but it is desirable that the temperature at the final pass (FT) of a finish rolling be equal to or above the $Ar_3$ transformation temperature. This is because, if the rolling temperature falls below the $Ar_3$ transformation temperature during hot rolling, a work-induced structure remains in ferrite having precipitated before or during the rolling, and, as a result, ductility is lowered and workability is deteriorated. However, when a heat treatment for recovery or recrystallization is to be applied during or after the subsequent coiling process, the temperature at the final pass (FT) of the finish rolling is allowed to be below the $Ar_3$ transformation temperature.

The present invention does not particularly specify an upper limit of a finishing temperature, but, if a finishing temperature exceeds the $Ar_3$ transformation temperature +100° C., it becomes substantially impossible to carry out rolling at a total reduction ratio of 25% or more in the temperature range of the $Ar_3$ transformation temperature +100° C. or lower. For this reason, it is desirable that the upper limit of a finishing temperature be the $Ar_3$ transformation temperature +100° C. or lower.

In the present invention, it is not necessary to particularly specify the microstructure of a steel sheet for the purpose of improving a shape fixation property and, thus, no specific limitation is set forth regarding the cooling process after the completion of finish rolling until the coiling at a prescribed coiling temperature. Nevertheless, a steel sheet is cooled, as occasion demands, for the purpose of securing a prescribed coiling temperature or controlling a microstructure.

The present invention does not particularly specify an upper limit of a cooling rate, but, since thermal strain may cause the warping of a steel sheet, it is desirable to control the cooling rate to 300° C./sec. or less. In addition, when a cooling rate is too high, it becomes impossible to accurately control the cooling end temperature and an over-cooling may happen as a result of overshooting to a temperature below a prescribed coiling temperature. For this reason, the cooling rate here is, desirably, 150° C./sec. or less. No lower limit of the cooling rate is set forth specifically, either. For reference, the cooling rate in the case where a steel sheet is left to cool naturally in room temperature without any intentional cooling is 5° C./sec. or more.

In order to obtain a low yield ratio for realizing a better shape fixation property than the once improved shape fixation property in the present invention, it is preferable that the microstructure of a steel sheet is a compound structure containing ferrite as the phase accounting for the largest volume percentage and martensite mainly as the second phase. To do so, a hot-rolled steel sheet has to be retained for 1 to 20 sec. in the temperature range from the $Ar_3$ transformation temperature to the $Ar_1$ transformation temperature (the ferrite-austenite two-phase zone) in the first place after completing finish rolling. In such manner, the retention of a hot-rolled steel sheet is carried out for accelerating ferrite transformation in the two-phase zone. If the retention time is less than 1 sec., the ferrite transformation in the two-phase zone is insufficient, and a sufficient ductility is not obtained, but, if it exceeds 20 sec., pearlite forms and the envisaged compound structure containing ferrite as the phase accounting for the largest volume percentage and martensite mainly as the second phase is not obtained.

In addition, in order to easily accelerate the ferrite transformation, it is desirable that the temperature range in which a steel sheet is retained for 1 to 20 sec. be from the $Ar_1$ transformation temperature to 800° C. Further, in order not to lower productivity drastically, it is desirable that the retention time, which has been defined earlier as from 1 to 20 sec., be 1 to 10 sec.

For satisfying all these conditions, it is preferable to reach the temperature range rapidly at a cooling rate of 20° C./sec. or more after completing finish rolling. The upper limit of a cooling rate is not particularly specified, but, in consideration of the capacity of cooling equipment, a reasonable cooling rate is 300° C./sec. or less. In addition, when a cooling rate is too high, it becomes impossible to accurately control the cooling end temperature and over-cooling may happen as a result of overshooting to the $Ar_1$ transformation temperature or below. For this reason, the cooling rate here is, desirably, 150° C./sec. or less.

Subsequently, a steel sheet is cooled at a cooling rate of 20° C./sec. or more from the above temperature range to a coiling temperature (CT). At a cooling rate below 20° C./sec., pearlite or bainite forms and a sufficient amount of martensite is not obtained and, as a result, the envisaged microstructure containing ferrite as the phase accounting for the largest volume percentage and martensite as the second phase is not obtained. The effects of the present invention can be enjoyed without bothering to particularly specify an upper limit of the cooling rate down to the coiling temperature but, for avoiding warping caused by thermal strain, it is preferable to control the cooling rate to 300° C./sec. or less.

In order to obtain a good ductility, in addition to improving the shape fixation property, in the present invention, it is preferable that the microstructure of a steel sheet is a compound structure containing retained austenite by 5% to 25% in terms of volume percentage and having the balance mainly consisting of ferrite and bainite. To do so, a hot-rolled steel sheet has to be retained for 1 to 20 sec. in the temperature range from the $Ar_3$ transformation temperature to the $Ar_1$ transformation temperature (the ferrite-austenite two-phase zone) in the first place after completing finish rolling. In such manner, the retention of a hot-rolled steel sheet is carried out for accelerating ferrite transformation in the two-phase zone. If the retention time is less than 1 sec., the ferrite transformation in the two-phase zone is insufficient and a sufficient ductility is not obtained, but, if it exceeds 20 sec., pearlite forms and the envisaged microstructure containing retained austenite by 5% to 25% in terms of volume percentage and having the balance mainly consisting of ferrite and bainite is not obtained. In addition, in order to easily accelerate the ferrite transformation, it is desirable that the temperature range in which a steel sheet is retained for 1 to 20 sec. be from the $Ar_1$ transformation temperature to 800° C. Further, in order not to lower productivity drastically, it is desirable that the retention time, which has been defined earlier as from 1 to 20 sec., be 1 to 10 sec.

For satisfying all these conditions, it is preferable to reach said temperature range rapidly at a cooling rate of 20° C./sec. or more after completing finish rolling. The upper limit of a cooling rate is not particularly specified, but, in consideration of the capacity of cooling equipment, a reasonable cooling rate is 300° C./sec. or less. In addition, when a cooling rate is too high, it becomes impossible to accurately control the cooling end temperature and over-cooling may happen as a result of overshooting to the $Ar_1$ transformation temperature or below. For this reason, the cooling rate here is, desirably, 150° C./sec. or less.

Subsequently, a steel sheet is cooled at a cooling rate of 20° C./sec. or more from the above temperature range to a coiling temperature (CT). At a cooling rate below 20° C./sec., pearlite or bainite containing carbides forms and a sufficient amount of retained austenite is not obtained and, as a result, the envisaged microstructure containing retained austenite by 5% to 25% in terms of volume percentage and having the balance mainly consisting of ferrite and bainite is not obtained. The effects of the present invention can be enjoyed without bothering to particularly specify an upper limit of the cooling rate down to the coiling temperature but, for avoiding warping caused by thermal strain, it is preferable to control the cooling rate to 300° C./sec. or less.

In order to obtain a good burring workability, in addition to improving a shape fixation property, in the present invention, it is preferable that the microstructure is a compound structure containing bainite or ferrite and bainite as the phase accounting for the largest volume percentage. To do so, the present invention does not particularly specify the process conditions after the completion of finish rolling until coiling at a prescribed coiling temperature, except for the cooling rate applied during the process. However, in case where a steel sheet is preferable to have both a good burring workability and a high ductility without sacrificing the burring workability too much, it is acceptable to retain a hot-rolled steel sheet for 1 to 20 sec. in the temperature range from the $Ar_3$ transformation temperature to the $Ar_1$ transformation temperature (the ferrite-austenite two-phase zone).

In such case, the retention of a hot-rolled steel sheet is carried out for accelerating ferrite transformation in the two-phase zone. If the retention time is less than 1 sec., the ferrite transformation in the two-phase zone is insufficient, and a sufficient ductility is not obtained, but, if it exceeds 20 sec., pearlite forms and the envisaged microstructure of a compound structure containing bainite or ferrite and bainite as the phase accounting for the largest volume percentage is not obtained. In addition, in order to easily accelerate the ferrite transformation, it is desirable that the temperature range in which a steel sheet is retained for 1 to 20 sec. be from the $Ar_1$ transformation temperature to 800° C. Further, in order not to lower productivity drastically, it is desirable that the retention time, which has been defined earlier as from 1 to 20 sec., be 1 to 10 sec.

For satisfying all these conditions, it is preferable to reach said temperature range rapidly at a cooling rate of 20° C./sec. or more after completing the finish rolling. The upper limit of a cooling rate is not particularly specified, but, in consideration of the capacity of cooling equipment, a reasonable cooling rate is 300° C./sec. or less. In addition, when a cooling rate is too high, it becomes impossible to accurately control the cooling end temperature and over-cooling may happen as a result of overshooting to the $Ar_1$ transformation temperature or below, losing the effect of improving ductility. For this reason, the cooling rate here is, desirably, 150° C./sec. or less.

Subsequently, a steel sheet is cooled at a cooling rate of 20° C./sec. or more from the above temperature range to a coiling temperature (CT). At a cooling rate below 20° C./sec., pearlite or bainite containing carbides forms and the envisaged microstructure of a compound structure containing bainite or ferrite and bainite as the phase accounting for the largest volume percentage is not obtained. The effects of the present invention can be utilized without the need to particularly specify an upper limit of the cooling rate down to the coiling temperature but, for avoiding warping caused by thermal strain, it is preferable to control the cooling rate to 300° C./sec. or less.

In addition, in order to obtain a steel sheet according to another exemplary embodiment of the present invention, it is not necessary to specify the process conditions after the completion of finish rolling until coiling at a prescribed coiling temperature (CT). However, in case where a steel sheet is preferable to have both a good burring workability and a high ductility without sacrificing the burring workability too much, it is acceptable to retain a hot-rolled steel sheet for 1 to 20 sec. in the temperature range from the $Ar_3$ transformation temperature to the $Ar_1$ transformation temperature (the ferrite-austenite two-phase zone). In such manner, the retention of a hot-rolled steel sheet is carried out for accelerating ferrite transformation in the two-phase zone. If the retention time is less than 1 sec., the ferrite transformation in the two-phase zone is insufficient, and a sufficient ductility is not obtained, but, if it exceeds 20 sec., the size of precipitates containing Ti and/or Nb becomes coarse and there arises a probability that they do not contribute to the increase of steel strength caused by precipitation strengthening. In addition, in order to easily accelerate the ferrite transformation, it is desirable that the temperature range in which a steel sheet is retained for 1 to 20 sec. be from the $Ar_1$ transformation temperature to 860° C. Further, in order not to lower productivity drastically, it is desirable that the retention time, which has been defined earlier as from 1 to 20 sec., be 1 to 10 sec.

For satisfying all these conditions, it is preferable to reach the temperature range rapidly at a cooling rate of 20° C./sec. or more after completing finish rolling. The upper limit of a cooling rate is not particularly specified, but, in consideration of the capacity of cooling equipment, a reasonable cooling rate is 300° C./sec. or less. In addition, when a cooling rate is too high, it becomes impossible to accurately control the cooling end temperature and over-cooling may happen as a result of overshooting to the $Ar_1$ transformation temperature or below, losing the effect of improving ductility. For this reason, the cooling rate here is, desirably, 150° C./sec. or less.

Subsequently, a steel sheet is cooled from the above temperature range to a prescribed coiling temperature (CT), but it is not necessary to particularly specify a cooling rate for obtaining the effects according to the exemplary embodiment of the present invention. However, when a cooling rate is too low, the size of precipitates containing Ti and/or Nb becomes coarse and there arises a probability that they do not contribute to the enhancement of steel strength caused by precipitation strengthening. For this reason, it is desirable that the lower limit of the cooling rate be 20° C./sec. or more. The effects of the present invention can be enjoyed without bothering to particularly specify an upper limit of the cooling rate down to the coiling temperature but, for avoiding warping caused by thermal strain, it is preferable to control the cooling rate to 300° C./sec. or less.

According to the present invention, it is not necessary to particularly specify the microstructure of a steel sheet for the purpose of improving a shape fixation property and, thus, the present invention does not particularly specify an upper limit of a coiling temperature. However, in order to carry over the texture of austenite obtained by a finish rolling at a total reduction ratio of 25% or more in the temperature range of the $Ar_3$ transformation temperature +100° C. or lower, it is desirable to coil a steel sheet at the coiling temperature T0 shown below or lower. It is unnecessary to set the temperature T0 equal to or below the room temperature. The temperature T0 is a temperature defined thermodynamically as a temperature at which austetite and ferrite having the same chemical components as the austenite have the same free energy. It can be calculated in a simplified manner by the following equation, taking the influences of components other than C into consideration:

$$T0=-650.4\times\%\ C+B,$$

where, B is determined as follows:

$$B=-50.6\times Mneq+894.3,$$

where, Mneq is determined from the mass percentages of the component elements as shown below:

$$Mneq=\%\ Mn+0.24\times\%\ Ni+0.13\times\%\ Si+0.38\times\%\ Mo+0.55\times\%\ Cr+0.16\times\%\ Cu-0.50\times\%\ Al-0.45\times\%\ Co+0.90\times\%\ V.$$

The influences on T0 of the mass percentages of the other components specified in the present invention than those included in the above equation are not significant, and are negligible here.

Since it is not necessary to particularly specify the microstructure of a steel sheet for the purpose of improving a shape fixation property, it is not necessary to particularly specify a lower limit of a coiling temperature. However, for avoiding poor appearance caused by rust when a coil is kept wet with water for a long period of time, it is desirable that a coiling temperature be 50° C. or above.

In order to obtain a low yield ratio, in addition to improving a shape fixation property, in the present invention, it is preferable that the microstructure is a compound structure containing ferrite as the phase accounting for the largest volume percentage and martensite mainly as the second phase. To do so, it is preferable that a coiling temperature be 350° C. or less. The reason is because, when a coiling temperature exceeds 350° C., bainite forms and a sufficient amount of martensite is not obtained and, as a result, the envisaged microstructure containing ferrite as the phase accounting for the largest volume percentage and martensite as the second phase is not obtained. It is not necessary to particularly set forth a lower limit of a coiling temperature but, for avoiding poor appearance caused by rust when a coil is kept wet with water for a long period of time, it is desirable that a coiling temperature be 50° C. or above.

In order to obtain a good ductility, in addition to improving a shape fixation property, in the present invention, it is preferable that the microstructure is a compound structure containing retained austenite by 5 to 25% in terms of volume percentage and having the balance mainly consisting of ferrite and bainite. To do so, a coiling temperature must be restricted to below 450° C. This is because, when a coiling temperature is 450° C. or higher, bainite containing carbides forms and a sufficient amount of retained austenite is not obtained and, as a result, the envisaged microstructure containing retained austenite by 5 to 25% in terms of volume percentage and having the balance mainly consisting of ferrite and bainite is not obtained. When a coiling temperature is 350° C. or lower, on the other hand, a great amount of martensite forms and a sufficient amount of retained austenite is not obtained and, as a result, the envisaged microstructure containing retained austenite by 5 to 25% in terms of volume percentage and having the balance mainly consisting of ferrite and bainite is not obtained. For this reason, the coiling temperature is limited to over 350° C.

Further, while the present invention does not particularly specify a cooling rate to be applied after coiling, when Cu is added by 1% or more, Cu precipitates after coiling and not only workability is deteriorated but also solute Cu effective for improving fatigue properties may be lost. For this reason, it is desirable that the cooling rate after coiling be 30° C./sec. or more up to the temperature of 200° C.

In order to obtain a good burring workability, in addition to improving the shape fixation property, in the present invention, it is preferable that the microstructure is a compound structure containing bainite or of ferrite and bainite as the phase accounting for the largest volume percentage. To do so, a coiling temperature has to be restricted to 450° C. or more. This is because, when a coiling temperature is below 450° C., retained austenite or martensite considered detrimental to burring workability may form in a great amount and, as a consequence, the envisaged microstructure of a compound structure containing bainite or ferrite and bainite as the phase accounting for the largest volume percentage is not obtained. Further, while the present invention does not particularly specify a cooling rate to be applied after coiling, when Cu is added by 1.2% or more, Cu precipitates after coiling and not only workability is deteriorated but also solute Cu effective for improving fatigue properties may be lost. For this reason, it is desirable that the cooling rate after coiling be 30° C./sec. or more up to the temperature of 200° C.

The present invention does not particularly specify a coiling temperature (CT) for the purpose of obtaining a steel sheet. However, in order to carry over the texture of austenite obtained by a finish rolling at a total reduction ratio of 25% or more in the temperature range of the $Ar_3$ transformation temperature +100° C. or lower, it is desirable to coil a steel sheet at the coiling temperature T0 shown below or lower. The temperature T0 is a temperature defined thermodynamically as a temperature at which austenite and ferrite having the same chemical components as the austenite have the same free energy. It can be calculated in a simplified manner by the following equation, taking the influences of components other than C into consideration:

$$T0=-650.4\times\%\ C+B,$$

where, B is determined as follows:

$$B=-50.6\times Mneq+894.3,$$

where, Mneq is determined from the mass percentages of the component elements as shown below:

$$Mneq=\%\ Mn+0.24\times\%\ Ni+0.13\times\%\ Si+0.38\times\%\ Mo+0.55\times\%\ Cr+0.16\times\%\ Cu-0.50\times\%\ Al-0.45\times\%\ Co+0.90\times\%\ V.$$

The influences on T0 of the mass percentages of the other components specified in the present invention than those included in the above equation are not significant, and are negligible here.

As for the lower limit of a coiling temperature (CT), on the other hand, it is desirable to coil a steel sheet at a temperature above 350° C., because, at 350° C. or below, the precipitates containing Ti and/or Nb do not form in a sufficient amount and solute C remains in the steel, probably deteriorating workability. Further, while the present invention does not particularly specify a cooling rate to be applied after coiling, when Cu is added by 1% or more and if the coiling temperature (CT) exceeds 450° C., Cu precipitates after coiling, and not only workability is deteriorated but also solute Cu effective for improving fatigue properties may be lost. For this reason, when a coiling temperature (CT) exceeds 450° C., it is desirable that the cooling rate after coiling be 30° C./sec. or more up to the temperature of 200° C.

After completing a hot rolling process, a steel sheet may undergo pickling, as occasion demands, and then skin pass rolling at a reduction ratio of 10% or less or cold rolling at a reduction ratio up to 40% or so, either in-line or off-line. However, in this case, in order to obtain the effect to reduce a friction coefficient by applying a composition having a lubricating effect, it is preferable to control the reduction ratio of the skin pass rolling so that the arithmetic average of roughness Ra of at least one of the surfaces of a steel sheet becomes 1 to 3.5 μm after the skin pass rolling.

Next, in the case where a cold-rolled steel sheet is used as a final product, the present invention does not particularly specify the conditions of finish hot rolling. However, for obtaining a better shape fixation property, it is desirable to apply a total reduction ratio of 25% or more in the temperature range of the $Ar_3$ transformation temperature +100° C. or lower. Further, while it is acceptable that the temperature at the final pass (FT) of a finish rolling be below the $Ar_3$ transformation temperature, in such a case, since an intensively work-induced structure remains in ferrite having precipitated before or during the rolling, it is desirable that the work-induced structure be recovered and recrystallized by a subsequent coiling process or heat treatment.

The total reduction ratio at a cold rolling subsequent to pickling is set at less than 80%. This is because, when the total reduction ratio at a cold rolling is 80% or more, the ratio of integrated X-ray diffraction strength in {111} and {554} crystal planes parallel to the plane of a steel sheet, which constitute a recrystallization texture usually obtained by cold rolling, tends to be large. A preferable total reduction ratio at a cold rolling is 70% or less. The effects of the exemplary embodiments of the present invention can be enjoyed without particularly specifying a lower limit of a cold reduction ratio, but, for controlling the X-ray diffraction strengths in the crystal orientation components within appropriate ranges, it is desirable to set the lower limit of a cold reduction ratio at 3% or more.

The discussion herein is based on, e.g., the assumption that the heat treatment of a cold-rolled steel sheet is carried out in a continuous annealing process.

A steel sheet is initially heat-treated for 5 to 150 sec. in the temperature range of the $Ac_3$ transformation temperature +100° C. or lower. If the upper limit of a heat treatment temperature exceeds the $Ac_3$ transformation temperature +100° C., ferrite having formed through recrystallization transforms into austenite, the texture formed by the growth of austenite grains is randomized, and the texture of ferrite finally obtained is also randomized. For this reason, the upper limit of a heat treatment temperature is determined to be the $Ac_3$ transformation temperature +100° C. or lower. The $Ac_1$ and $Ac_3$ transformation temperatures mentioned here can be expressed in relation to steel chemical components using, for example, the expressions according to p. 273 of the Japanese translation of The Physical Metallurgy of Steels by W. C. Leslie (published from Maruzen in 1985, translated by Hiroshi Kumai and Tatsuhiko Noda). It is acceptable if the lower limit of a heat treatment temperature is equal to or above the recovery temperature, because it is not necessary to particularly specify the microstructure of a steel sheet for the purpose of improving a shape fixation property. When a heat treatment temperature is below the recovery temperature, however, a work-induced structure is retained and formability is significantly deteriorated. For this reason, the lower limit of a heat treatment temperature is determined to be equal to or above the recovery temperature. For obtaining yet better ductility, it is desirable that a heat treatment temperature be equal to or above the recrystallization temperature of a steel.

Further, with regard to a retention time in the above temperature range, if the retention time is shorter than 5 sec., it is insufficient for having cementite completely dissolve again, but, if the retention time exceeds 150 sec., the effect of the heat treatment is saturated and, what is more, productivity is lowered. For this reason, the retention time is determined to be in the range from 5 to 150 sec.

In addition, in the case of a steel sheet according to the exemplary embodiment of the present invention, in particular, the retention time is determined to be in the range from 5 to 150 sec. too, because, if the retention time in the temperature range is shorter than 5 sec., it is insufficient for carbonitrides of Ti and Nb to completely dissolve again, but, if the retention time exceeds 150 sec., the effect of the heat treatment is saturated and, what is more, productivity is lowered.

The present invention does not particularly specify the conditions of cooling after a heat treatment. However, for the purpose of controlling a microstructure, a mere cooling process or the combination of a retention process at a certain temperature with a cooling process may be employed as occasion demands, as it is mentioned later.

In order to obtain a low yield ratio, in addition to improving a shape fixation property, according to the present invention, it is preferable that the microstructure is a compound structure containing ferrite as the phase accounting for the largest volume percentage and martensite mainly as the second phase. To do so, a hot-rolled steel sheet is determined to be retained for 5 to 150 sec. in the temperature range from the $Ac_1$ transformation temperature to the $Ac_3$ transformation temperature +100° C., as described earlier. In this case, if cementite has precipitated in an as hot-rolled state and if the temperature is too low even it is within said temperature range, it takes too long a time for the cementite to dissolve again. When the temperature is too high, on the other hand, the volume percentage of austenite becomes too large and the concentration of C in the austenite becomes too low, and, as a consequence, the temperature history of the steel is likely to pass through the transformation nose of bainite or pearlite containing much carbide. For this reason, it is desirable to heat the steel sheet to a temperature from 780 to 850° C.

If a cooling rate after the retention is below 20° C./sec., the temperature history of the steel is likely to pass through the transformation nose of bainite or pearlite containing much carbide, and, for this reason, the cooling rate is determined to be 20° C./sec. or more. If a cooling end temperature is above 350° C., the envisaged microstructure containing ferrite as the phase accounting for the largest volume percentage and martensite as the second phase is not obtained. For this reason, the cooling must be continued down to a temperature of 350° C. or lower. The present invention does not particularly specify a lower limit of a temperature at the end of a cooling process, but, if water cooling or mist cooling is applied and a coil is kept wet with water for a long period of time, for avoiding poor appearance caused by rust, it is desirable that a temperature at the end of a cooling process be 50° C. or above.

In order to obtain a good ductility, in addition to improving a shape fixation property, in the present invention, it is preferable that the microstructure is a compound structure containing retained austenite by 5 to 25% in terms of volume percentage and having the balance mainly consisting of ferrite and bainite. To do so, a steel sheet is determined to be heat-treated for 5 to 150 sec. in a temperature range from the $Ac_1$ transformation temperature to the $Ac_3$ transformation temperature +100° C., as described earlier. In this case, if cementite has precipitated in an as hot-rolled state and if the temperature is too low even within the temperature range, it takes too long a time for the cementite to dissolve again. When the temperature is too high, on the other hand, the volume percentage of austenite becomes too large and the concentration of C in the austenite becomes too low, and, as a consequence, the temperature history of the steel is likely to pass through the transformation nose of bainite or pearlite containing much carbide. For this reason, it is desirable to heat the steel sheet to a temperature from 780 to 850° C. If a cooling rate after the retention is below 20° C./sec., the temperature history of the steel is likely to pass through the transformation nose of bainite or pearlite containing much carbide, and, for this reason, the cooling rate is determined to be 20° C./sec. or more.

Next, with respect to a process to accelerate bainite transformation and stabilize a preferable amount of retained austenite, if a temperature at the end of cooling is 450° C. or higher, the retained austenite is decomposed into bainite or pearlite containing much carbide, and the envisaged microstructure containing retained austenite by 5 to 25% in terms of volume percentage and having the balance mainly consisting of ferrite and bainite is not obtained. If a cooling end temperature is below 350° C., martensite may form in a great amount and a sufficient amount of retained austenite cannot be secured and, as a result, the envisaged microstructure containing retained austenite by 5 to 25% in terms of volume percentage and the balance mainly consisting of ferrite and bainite is not obtained. For this reason, the cooling must be carried out to the temperature range of above 350° C.

Further, with respect to the retention time in the above temperature range, if the retention time is shorter than 5 sec., bainite transformation for stabilizing retained austenite is insufficient and, as a consequence, the unstable retained austenite may transform into martensite at the end of the subsequent cooling stage, and, as a result, the envisaged microstructure containing retained austenite by 5 to 25% in terms of volume percentage and having the balance mainly consisting of ferrite and bainite is not obtained. If the retention time exceeds 600 sec., on the other hand, bainite transformation overshoots and a preferable amount of stable retained austenite is not formed, and, as a result, the envisaged microstructure containing retained austenite by 5 to 25% in terms of volume percentage and having the balance mainly consisting of ferrite and bainite is not obtained. For this reason, the retention time in the temperature range is determined to be from 5 to 600 sec.

If a cooling rate up to the end of cooling is below 5° C./sec., there is a probability that the bainite transformation overshoots during the cooling and a preferable amount of stable retained austenite is not formed, and, as a consequence, the envisaged microstructure containing retained austenite by 5 to 25% in terms of volume percentage and having the balance mainly consisting of ferrite and bainite may not be obtained. Therefore, the cooling rate is determined to be 5° C./sec. or more. In addition, if a temperature at the end of cooling exceeds 200° C., an aging property may be deteriorated and, therefore, a cooling end temperature is determined to be 200° C. or lower. The present invention does not particularly specify the lower limit of a temperature at the end of cooling, but, if water cooling or mist cooling is applied and a coil is kept wet with water for a long period of time, for avoiding poor appearance caused by rust, it is desirable that a cooling end temperature be 50° C. or above.

Additionally, in order to obtain a good burring workability, in addition to improving a shape fixation property, in the present invention, it is preferable that the microstructure of a compound structure containing bainite or ferrite and bainite as the phase accounting for the largest volume percentage is obtained. To do so, the lower limit of the heat treatment temperature is determined to be the $Ac_1$ transformation temperature or higher. If the lower limit of the heat treatment temperature is below the $Ac_1$ transformation temperature, the envisaged compound structure containing bainite or of ferrite and bainite as the phase accounting for the largest volume percentage is not obtained. When it is intended to obtain both a good burring workability and a high ductility without sacrificing the burring workability too much, the heat treatment temperature is determined to be in the range from the $Ac_1$ transformation temperature to the $Ac_3$ transformation temperature (the ferrite-austenite two-phase zone) for the purpose of increasing the volume percentage of ferrite. Further, in order to obtain a yet better burring workability, it is desirable that the heat treatment temperature is in the range from the $Ac_3$ transformation temperature to the $Ac_3$ transformation temperature +100° C. for increasing the volume percentage of bainite.

The present invention does not particularly specify the conditions of a cooling process, but, when said heat treatment temperature is in the range from $Ac_1$ transformation temperature to $Ac_3$ transformation temperature, it is desirable to cool a steel sheet at a cooling rate of 20° C./sec. or more to the temperature range from over 350° C. to not more than the temperature T0 specified herein earlier. This is because, if a cooling rate is below 20° C./sec., the temperature history of the steel is likely to pass through the transformation nose of bainite or pearlite containing much carbide. Further, when a cooling end temperature is 350° C. or lower, martensite, which is considered detrimental to burring properties, may form in a great amount and, as a result, the envisaged compound structure containing bainite or ferrite and bainite as the phase accounting for the largest volume percentage is not obtained. For this reason, it is desirable that a cooling end temperature be above 350° C. In addition, in order to carry over the texture obtained up to the previous process, it is desirable that the cooling end temperature be T0 or lower.

If a cooling rate down to the temperature at the end of a cooling process is 20° C./sec. or more, there is a probability that martensite, which is considered detrimental to burring properties, forms in a great amount during the cooling and, as a result, the envisaged compound structure containing bainite or ferrite and bainite as the phase accounting for the largest volume percentage may not be obtained. Consequently, it is desirable that the cooling rate be below 20° C./sec. Besides, if a temperature at the end of a cooling process exceeds 200° C., aging properties may be deteriorated. Therefore, it is desirable that the temperature at the end of the cooling process be 200° C. or lower. For avoiding poor appearance caused by rust, if water cooling or mist cooling is applied and a coil is kept wet with water for a long period of time, it is desirable that the lower limit of a temperature at the end of a cooling process be 50° C. or above.

On the other hand, in the case where said heat treatment temperature is within the range from the $Ac_3$ transformation temperature to the $Ac_3$ transformation temperature +100° C., it is desirable to cool a steel sheet at a cooling rate of 20° C./sec. or more to a temperature of 200° C. or below. This is because, if a cooling rate is below 20° C./sec., the temperature history of the steel is likely to pass through the transformation nose of bainite or pearlite containing much carbide. In addition, if a temperature at the end of a cooling process exceeds 200° C., aging properties may be deteriorated. Therefore, it is desirable that a temperature at the end of a cooling process be 200° C. or lower. For avoiding poor appearance caused by rust, if water cooling or mist cooling is applied and a coil is kept wet with water for a long period of time, it is desirable that the lower limit of a temperature at the end of a cooling process be 50° C. or above.

In additional, for the purpose of obtaining a steel sheet according to the exemplary embodiment of the present invention, it is not necessary to particularly specify the conditions of cooling after the heat treatment. However, it is desirable that a steel sheet is cooled at a cooling rate of 20° C./sec. or more to a temperature range from over 350° C. to the temperature T0 specified herein earlier. This is because, if a cooling rate is below 20° C./sec., it is concerned that the size of precipitates containing Ti and/or Nb becomes coarse and they do not contribute to the increase of strength through precipitation strengthening. In addition, if a cooling end temperature is 350° C. or below, there is a probability that the precipitates containing Ti and/or Nb do not form in a sufficient amount, and solute C remains in steel, deteriorating workability. For this reason, it is desirable that a cooling end temperature be above 350° C. Further, if a temperature at the end of a cooling process is over 200° C., aging properties may be deteriorated and, for this reason, it is desirable that a temperature at the end of a cooling process be 200° C. or lower. If water cooling or mist cooling is applied and a coil is kept wet with water for a long period of time, for avoiding poor appearance caused by rust, it is desirable that the lower limit of a temperature at the end of a cooling process be 50° C. or above.

After the above-mentioned processes, a skin pass rolling is applied as occasion demands. In this case, in order to obtain the effect to lower a friction coefficient by applying a composition having a lubricating effect, the reduction ratio of a skin pass rolling has to be so controlled that the arithmetic average of roughness Ra of at least one of the surfaces of a steel sheet is 1 to 3.5 μm after the rolling.

In order to apply zinc plating to a hot-rolled steel sheet after pickling or a cold-rolled steel sheet after completing the above heat treatment for recrystallization, the steel sheet has to be dipped in a zinc plating bath. It may be subjected to an alloying process as occasion demands.

In order to secure a good drawability, a composition having a lubricating effect is applied to a steel sheet after completing the above-mentioned production processes. The method of the application is not limited specifically as far as a desired coating thickness is obtained. Electrostatic coating or a method using a roll coater is commonly employed.

EXAMPLE 1

Steels A to L having the chemical components listed in Table 1 were melted and refined in a converter, cast continuously into slabs, reheated and then rolled through rough rolling and finish rolling into steel sheets 1.2 to 5.5 mm in thickness, and then coiled. The chemical components in the table are expressed in terms of mass percent.

Table 2 shows the details of the production conditions. In the table, "SRT" means the slab reheating temperature, "FT" the finish rolling temperature at the final pass, and "reduction ratio" the total reduction ratio in the temperature range of the $Ar_3$ transformation temperature +100° C. or lower. In the case where a steel sheet is cold-rolled after being hot-rolled, the restriction is not necessary to be applied and, therefore, each relevant space of "reduction ratio" is filled with a horizontal bar, meaning "not applicable." Further, "lubrication" indicates if or not lubrication is applied in the temperature range of the $Ar_3$ transformation temperature +100° C. or lower. In the column of "coiling", γ means that a coiling temperature (CT) is T0 or lower, and x that a coiling temperature is above T0. Since it is not necessary to restrict the coiling temperature as one of the production conditions in the case of a cold-rolled steel sheet, each relevant space is filled with a horizontal bar, meaning "not applicable." Some of the steel sheets underwent pickling, cold rolling and annealing after hot rolling. The thickness of the cold-rolled steel sheets ranged from 0.7 to 2.3 mm.

Also in the table, "cold reduction ratio" means a total cold reduction ratio, and "time" the time of annealing. In the column of "annealing", γ means that the annealing temperature is within the range from the recovery temperature to the $Ar_3$ transformation temperature +100° C., and x that it is outside the range. Steel L underwent a descaling under the condition of an impact pressure of 2.7 MPa and a flow rate of 0.001 $l/cm^2$ after rough rolling. Further, among the steels mentioned above, steels G and F-5 underwent zinc plating. Further, after completing the above production processes, a composition having a lubricating effect was applied using an electrostatic coating apparatus or a roll coater.

A hot-rolled steel sheet thus prepared was subjected to a tensile test by forming a specimen into a No. 5 test piece according to JIS Z 2201 and in accordance with the test method specified in JIS Z 2241. The yield strength (σY), tensile strength (σB) and breaking elongation (El) are shown in Tables 2-1 and 2-2.

Then, a test piece 30 mm in diameter were cut out from a position of ¼ or ¾ of the width of a steel sheet, the surfaces were ground up to the three-triangle grade finish (the second finest finish) and, subsequently, strain was removed by chemical polishing or electrolytic polishing. A test piece thus prepared was subjected to X-ray diffraction strength measurement in accordance with the method described in pages 274 to 296 of the Japanese translation of Elements of X-ray Diffraction by B. D. Cullity (published in 1986 from AGNE Gijutsu Center, translated by Gentaro Matsumura).

In such manner, the average ratio of the X-ray strength in the orientation component group of {100}<011> to {223}<110> to random X-ray diffraction strength was obtained by obtaining the X-ray diffraction strengths in the principal orientation components included in the orientation component group, namely {100}<011>, {116}<110>, {114}<110>, {113}<110>, {112}<110>, {335}<110> and {223}<110>, from the three-dimensional texture calculated by, either the vector method based on the pole figure of {110} or the series expansion method using two or more (desirably, three or more) pole figures out of the pole figures of {110}, {100}, {211} and {310}.

For example, as the ratio of the X-ray strength in the above crystal orientation components to random X-ray diffraction strength calculated by the latter method, the strengths of (001)[1-10], (116)[1-10], (114)[1-10], (113)[1-10], (112)[1-10], (335)[1-10] and (223)[1-10] at a $\phi 2=45°$ cross section in a three-dimensional texture can be used without modification. The average ratio of the X-ray strength in the orientation component group of {100}<011> to {223}<110> to random X-ray diffraction strength is the arithmetic average ratio in all the above orientation components.

When it is impossible to obtain the strengths in all these orientation components, the arithmetic average of the strengths in the orientation components of {100}<011>, {116}<110>, {114}<110>, {112}<110> and {223}<110> may be used as a substitute.

In addition to the above, the average ratio of the X-ray strength in three orientation components of {554}<225>, {111}<112> and {111}<110> to random X-ray diffraction strength can be calculated from the three-dimensional texture obtained in the same manner as above.

In Table 2, "strength 1" under "ratios of X-ray strength to random X-ray diffraction strength" means the average ratio of the X-ray strength in the orientation component group of {100}<011> to {223}<110> to random X-ray diffraction strength, and "strength 2" the average ratio of the X-ray strength in the above three orientation components of {554}<225>, {111}<112> and {111}<110> to random X-ray diffraction strength.

Then, for the purpose of examining the shape fixation property of a steel sheet, a test piece 50 mm in width and 270 mm in length was cut out from a position of ¼ or ¾ of the width of the steel sheet so that the length was in the rolling direction, and it was subjected to a hat bending test using a punch 78 mm in width having shoulders 5 mm in radius, and a die having shoulders 5 mm in radius. The shape of the test piece having undergone the bending test was measured along the width centerline using a three-dimensional shape measuring apparatus. A shape fixation property was evaluated using the following indicators: dimensional accuracy evaluated by the value obtained by subtracting the width of the punch from the distance between points (5) as shown in FIG. 1; the amount of spring back defined by the average of the two values at the left and right portions, obtained by subtracting 90° from the angle between the straight line passing through points (1) and (2) and the straight line passing through points (3) and (4); and the amount of wall warping defined by the average of the inverse numbers of the curvature between points (3) and (5) at the left and right portions.

The amounts of spring back and wall warping vary depending on a blank holding force (BHF). The tendency of the effects of the present invention does not change even under various BHF conditions, but, in consideration of the fact that too high BHF cannot be imposed when an actual part is pressed in a production site, this time, the hat bending test is applied to various steel sheets under the BHF of 29 kN. Based on the dimensional accuracy and wall warping amount obtained by the bending test, a shape fixation property can be finally judged in terms of the dimensional accuracy (Δd). Since, as it is well known, dimensional accuracy lowers as the strength of a steel sheet increases, the value Δd/σB shown in Table 2 is used as an indicator of the shape fixation property.

An arithmetic average of roughness Ra was measured using a non-contact laser type measuring apparatus and in accordance with the method specified in JIS B 0601-1994.

Figure 2:
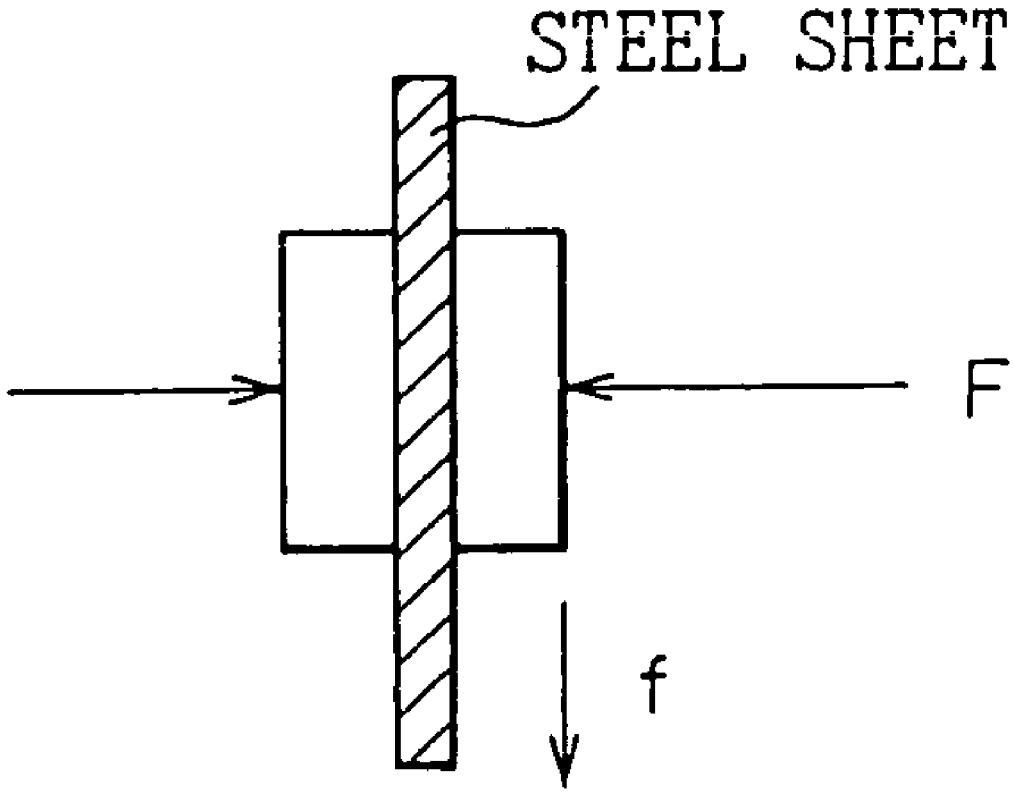
FIG. 2 is an illustration indicating details of a friction coefficient measuring apparatus according to the present invention.

A friction coefficient was defined as the ratio (f/F) of a drawing force (f) to a pressing force (F) in the following test procedures: as seen in FIG. 2, a steel sheet to be evaluated was placed between two flat plates having a Vickers hardness of Hv600 or more at the surfaces; a force (F) perpendicular to the surfaces of the subject steel sheet was imposed so that the contact stress was 1.5 to 2 kgf/mm$^2$; and the force (f) preferable for pulling out the subject steel sheet from between the flat plates was measured.

In the last place, an index of drawability of a steel sheet was defined as the quotient (D/d) obtained by dividing the maximum diameter (D) in which drawing had been successful by the diameter (d) of a cylindrical punch when a steel sheet was formed into a disk-shape and subjected to drawing work using the cylindrical punch. In this test, steel sheets were formed into various disk-shapes 300 to 400 mm in diameter, and a cylindrical punch 175 mm in diameter having a shoulder 10 mm in radius around the bottom face and a die having a shoulder 15 mm in radius were used in the evaluation of drawability. With regard to a blank holding force, 5 kN was imposed in the case of steels A to D, 100 kN in the case of steels E, F-1 to F-10, G and I to L, and 150 kN in the case of steel H.

It was understood that all the steel sheets having the friction coefficient within the range of the present invention showed a higher drawability index (D/d) than a steel sheet having the friction coefficient above the range of the present invention and the drawability index of any of the former steel sheets was 1.91 or more.

The examples according to the present invention are 11 steels, namely steels A, E, F-1, F-2, F-7, G, H, I, J, K and L. In these examples, obtained are the high-strength thin steel sheets drawable and excellent in a shape fixation property: characterized in that, the steel sheets contain prescribed amounts of components, at least on a plane at the center of the thickness of any of the steel sheets, the average ratio of the X-ray strength in the orientation component group of {100}<011> to {223}<110> to random X-ray diffraction strength is 3 or more and the average ratio of the X-ray strength in three orientation components of {554}<225>, {11}<112> and {111}<110> to random X-ray diffraction strength is 3.5 or less, the arithmetic average of the roughness Ra of at least one of the surfaces is 1 to 3.5 μm, and the surfaces of the steel sheet is covered with a composition having a lubricating effect; and further characterized in that at least one of the friction coefficients in the rolling direction and in the direction perpendicular to the rolling direction at 0 to 200° C. is 0.05 to 0.2. As a consequence, in the evaluations by the methods according to the present invention, the indices of the shape fixation property of these steels were superior to those of conventional steels.

The steels in the tables other than those mentioned above were outside the ranges of the present invention for the following reasons.

In steel B, the content of C was outside the range specified in claim 6 of the present invention and, as a consequence, a sufficient strength (σB) was not obtained. In steel C, the content of P was outside the range specified in claim 6 of the present invention and, as a consequence, good fatigue properties were not obtained. In steel D, the content of S was outside the range specified in claim 6 of the present invention and, as a consequence, a sufficient elongation (El) was not obtained. In steel F-3, since a composition having a lubricating effect was not applied, the envisaged friction coefficient specified in claim 2 was not obtained and, as a consequence, a sufficient drawability (D/d) was not obtained.

In steel F-4, since the arithmetic average of roughness Ra was outside the range specified in claim 1 of the present invention, the envisaged friction coefficient specified in claim 2 was not obtained and, as a consequence, a sufficient drawability (D/d) was not obtained. In steel F-5, since the total reduction ratio in the temperature range of the $Ar_3$ transformation temperature +100° C. or lower was outside the range specified in claim 17 of the present invention, the envisaged texture specified in claim 1 was not obtained and, as a consequence, a sufficient shape fixation property (Δd/σB) was not obtained.

In steel F-6, since the finish-rolling termination temperature (FT) was outside the range specified in claim 17 of the present invention and the coiling temperature was also outside the range specified in the description of the present invention, the envisaged texture specified in claim 1 was not obtained and, as a consequence, a sufficient shape fixation property (Δd/σB) was not obtained. In steel F-8, since the cold reduction ratio was outside the range specified in claim 24 of the present invention, the envisaged texture specified in claim 1 was not obtained and, as a consequence, a sufficient shape fixation property (Δd/σB) was not obtained. In steel F-9, since the annealing temperature was outside the range specified in claim 24 of the present invention, the envisaged texture specified in claim 1 was not obtained and, as a consequence, a sufficient shape fixation property (Δd/σB) was not obtained. In steel F-10, since the annealing time was outside the range specified in claim 24 of the present invention, the envisaged texture specified in claim 1 was not obtained and, as a consequence, a sufficient shape fixation property (Δd/σB) was not obtained.

As has been explained in detail, the present invention relates to a high-strength thin steel sheet drawable and excellent in a shape fixation property and a method of producing the steel sheet. By using the high-strength thin steel sheet, a good drawability is realized even with a steel sheet having a texture disadvantageous for drawing work, and both a good shape fixation property and a high drawability can be realized at the same time. For this reason, the present invention is highly valuable industrially.

EXAMPLE 2

Steels A to L having the chemical components listed in Table 3 were melted and refined in a converter, cast continuously into slabs, reheated at the temperatures shown in Table 4 and then rolled through rough rolling and finish rolling into steel sheets 1.2 to 5.5 mm in thickness, and then coiled. The chemical components in the table are expressed in terms of mass percent. As shown in Tables 4-1, 4-2 and 4-3, some of the steels were hot-rolled with lubrication. Steel L underwent a descaling under the condition of an impact pressure of 2.7 MPa and a flow rate of 0.001 l/cm$^2$ after rough rolling. Further, some of the steel sheets underwent pickling, cold rolling and heat treatment, as shown in Table 2, after the hot rolling process. The thickness of the cold-rolled steel sheets ranged from 0.7 to 2.3 mm. In addition, among the steels mentioned above, steels G and A-8 underwent zinc plating.

Table 4 shows the production conditions in detail. In the table, "SRT" means the slab reheating temperature, "FT" the finish rolling temperature at the final pass, and "reduction ratio" the total reduction ratio in the temperature range of the $Ar_3$ transformation temperature +100° C. or lower. In the case where a steel sheet is cold-rolled after being hot-rolled, the restriction is not necessary to be applied and, therefore, each relevant space of "reduction ratio" is filled with a horizontal bar, meaning "not applicable." Further, "lubrication" indicates if or not lubrication is applied in the temperature range of the $Ar_3$ transformation temperature +100° C. or lower. "CT" means the coiling temperature. However, since it is not necessary to restrict the coiling temperature as one of the production conditions in the case of a cold-rolled steel sheet, each relevant space is filled with a horizontal bar, meaning "not applicable." Then, "cold reduction ratio" means the total cold reduction ratio, "ST" the heat treatment temperature, and "time" a heat treatment time.

After completing the above production processes, a composition having a lubricating effect was applied using an electrostatic coating apparatus or a roll coater.

A hot-rolled steel sheet thus prepared was subjected to a tensile test by forming a specimen into a No. 5 test piece according to JIS Z 2201 and in accordance with the test method specified in JIS Z 2241. The yield strength (σY), tensile strength (σB) and breaking elongation (El) are shown in Table 4. In the meantime, burring workability (hole expansibility) was evaluated following the hole expansion test method according to the Standard of the Japan Iron and Steel Federation JFS T 1001-1996. Table 4 shows the hole expansion ratio (λ).

An X-ray diffraction strength was measured by the same method as employed in Example 1.

A shape fixation property was evaluated also in the same manner as employed in Example 1.

Further, an arithmetic average of roughness Ra was measured also by the same method as employed in Example 1.

Likewise, a friction coefficient was measured by the same method as employed in Example 1.

A drawability index of a steel sheet was calculated in the same manner as employed in Example 1. A blank holding force of 10 kN was imposed in the case of steels B, 100 kN in the case of steel J, and 120 kN in the case of steels A, C, E, F, G, H, I and K.

It was understood that all the steel sheets having the friction coefficients within the range of the present invention showed a higher drawability index (D/d) than a steel sheet having the friction coefficient above the range of the present invention and the drawability index of any of the former steel sheets was 1.91 or more.

The examples according to the present invention are 12 steels, namely steels A-1, A-3, A-4, A-8, A-10, C, E, G, H, I, J, and L. In these examples, high-strength thin steel sheets drawable and excellent in a shape fixation property and a burring property are obtained: characterized in that, the steel sheets contain prescribed amounts of components, at least on a plane at the center of the thickness of any of the steel sheets, the average ratio of the X-ray strength in the orientation component group of {100}<011> to {223}<110> to random X-ray diffraction strength is 3 or more and the average ratio of the X-ray strength in three orientation components of {554}<225>, {111}<112> and {111}<110> to random X-ray diffraction strength is 3.5 or less, the arithmetic average of roughness Ra of at least one of its surfaces is 1 to 3.5 μm, and the surfaces of the steel sheet are covered with a composition having a lubricating effect; and further characterized in that at least one of the friction coefficients in the rolling direction and in the direction perpendicular to the rolling direction at 0 to 200° C. is 0.05 to 0.2. As a consequence, in the evaluations by the methods according to the present invention, the indices of the shape fixation property of these steels were superior to those of conventional steels.

All the steel sheets in the tables other than those mentioned above were outside the ranges of the present invention for the following reasons.

In steel A-2, since the finish rolling termination temperature (FT) and the total reduction ratio in the temperature range of the $Ar_3$ transformation temperature +100° C. or lower were outside their respective ranges specified in claim 21 of the present invention, the envisaged texture specified in claim 1 was not obtained and, as a consequence, a sufficient shape fixation property (Δd/σB) was not obtained. In steel A-5, since a composition having a lubricating effect was not applied, the envisaged friction coefficient specified in claim 2 was not obtained and, as a consequence, a sufficient drawability (D/d) was not obtained. In steel A-6, since the arithmetic average of roughness Ra was outside the range specified in claim 1 of the present invention, the envisaged friction coefficient specified in claim 2 was not obtained and, as a consequence, a sufficient drawability (D/d) was not obtained. In steel A-7, since the heat treatment temperature (ST) was outside the range specified in any one of claim 28 of the present invention, the envisaged texture specified in claim 1 (should be any one of 3 to 5?) was not formed and, as a consequence, a sufficient shape fixation property (Δd/σB) was not obtained. In steel A-9, since the cold reduction ratio was outside the range specified in any one of claim 28 of the present invention, the envisaged texture specified in any one of claim 1 was not obtained and, as a consequence, a sufficient shape fixation property (Δd/σB) was not obtained.

In steel B, the content of C was outside the range specified in claim 8 of the present invention and, as a consequence, a sufficient strength (σB) was not obtained. In steel D, the content of Ti was outside the range specified in any one of claim 8 of the present invention and, as a consequence, neither a sufficient strength (σB) nor a good shape fixation property (Δd/σB) was obtained. In steel F, the content of C was outside the range specified in claim 8 of the present invention and, as a consequence, a sufficient hole expansion ratio (λ) was not obtained. In steel I, the content of S was outside the range specified in claim 8 of the present invention and, as a consequence, neither a sufficient hole expansion ratio (λ) nor a good elongation (El) was obtained. In steel K, the content of N was outside the range specified in claim 8 of the present invention and, as a consequence, neither a sufficient hole expansion ratio (λ) nor a good elongation (El) was obtained.

As has been explained in detail, the present invention relates to a high-strength thin steel sheet drawable and excellent in a shape fixation property and a method of producing the steel sheet. By using the high-strength thin steel sheet, a good drawability is realized even with a steel sheet having a texture disadvantageous for drawing work, and both a good shape fixation property and a high drawability can be realized at the same time. For this reason, the present invention is highly valuable industrially.

TABLE 1

| Steel | Chemical composition (in mass %) C | Si | Mn | P | S | Al | Others | Remarks |
|---|---|---|---|---|---|---|---|---|
| A | 0.041 | 0.02 | 0.26 | 0.012 | 0.0011 | 0.033 | REM: 0.0008 | Invented steel |
| B | 0.002 | 0.01 | 0.11 | 0.011 | 0.0070 | 0.044 | Ti: 0.057 | Comparative steel |
| C | 0.022 | 0.02 | 0.22 | 0.300 | 0.0015 | 0.012 | | Comparative steel |
| D | 0.018 | 0.04 | 0.55 | 0.090 | 0.0400 | 0.033 | | Comparative steel |
| E | 0.058 | 0.92 | 1.16 | 0.008 | 0.0009 | 0.041 | Cu: 0.48, B: 0.0002 | Invented steel |
| F | 0.081 | 0.88 | 1.24 | 0.007 | 0.0008 | 0.031 | | Invented steel |
| G | 0.049 | 0.91 | 1.27 | 0.006 | 0.0011 | 0.025 | Cu: 0.78, Ni: 0.33 | Invented steel |
| H | 0.094 | 1.89 | 1.87 | 0.008 | 0.0007 | 0.024 | Ti: 0.071, Nb: 0.022 | Invented steel |
| I | 0.060 | 1.05 | 1.16 | 0.007 | 0.0008 | 0.033 | Mo: 0.11 | Invented steel |
| J | 0.061 | 0.91 | 1.21 | 0.005 | 0.0011 | 0.030 | V: 0.02, Cr: 0.08 | Invented steel |
| K | 0.055 | 1.21 | 1.10 | 0.008 | 0.0007 | 0.024 | Zr: 0.03 | Invented steel |
| L | 0.050 | 1.14 | 1.00 | 0.007 | 0.0009 | 0.031 | Ca: 0.0005 | Invented steel |

Underlined values are outside range of the invented steel.

TABLE 2-1

| | | Production conditions | | | | | | | | Ratios of X-ray strength to random X-ray diffraction strength | |
|---|---|---|---|---|---|---|---|---|---|---|---|
| | | Hot rolling process | | | | | Cold rolling and annealing processes | | | | |
| Steel | Classification | SRT (° C.) | FT (° C.) | Reduction ratio (%) | Lubrication | Coiling | Cold reduction ratio (%) | Annealing | Time (S) | Strength ratio 1 | Strength ratio 2 |
| A | Hot-rolled | 1250 | 880 | 42 | Not applied | γ | — | — | — | 5.8 | 0.7 |
| B | Hot-rolled | 1250 | 890 | 30 | Applied | γ | — | — | — | 1.3 | 6.1 |
| C | Hot-rolled | 1200 | 880 | 30 | Not applied | γ | — | — | — | 0.8 | 1.3 |
| D | Hot-rolled | 1200 | 880 | 30 | Not applied | γ | — | — | — | 1.2 | 0.9 |
| E | Hot-rolled | 1150 | 870 | 42 | Not applied | γ | — | — | — | 8.1 | 1.8 |
| F-1 | Hot-rolled | 1200 | 870 | 42 | Not applied | γ | — | — | — | 7.2 | 2.1 |
| F-2 | Hot-rolled | 1200 | 870 | 42 | Applied | γ | — | — | — | 8.3 | 1.4 |
| F-3 | Hot-rolled | 1200 | 870 | 42 | Applied | γ | — | — | — | 8.1 | 1.5 |
| F-4 | Hot-rolled | 1200 | 970 | 42 | Not applied | γ | — | — | — | 8.4 | 1.4 |
| F-5 | Hot-rolled | 1300 | 950 | 0 | Not applied | γ | — | — | — | 1.8 | 1.5 |
| F-6 | Hot-rolled | 1300 | 970 | 0 | Not applied | x | — | — | — | 1.8 | 1.7 |
| F-7 | Cold-rolled | 1200 | 860 | — | Applied | — | 65 | γ | 90 | 4.2 | 2.3 |
| F-8 | Cold-rolled | 1200 | 860 | — | Applied | — | 80 | γ | 90 | 2.8 | 4.2 |
| F-9 | Cold-rolled | 1200 | 860 | — | Applied | — | 65 | x | 90 | 1.7 | 2.6 |
| F-10 | Cold-rolled | 1200 | 860 | — | Applied | — | 65 | γ | 2 | 1.8 | 2.2 |
| G | Hot-rolled | 1150 | 870 | 71 | Not applied | γ | — | — | — | 8.5 | 0.8 |
| H | Hot-rolled | 1250 | 870 | 30 | Applied | γ | — | — | — | 8.7 | 0.9 |
| I | Hot-rolled | 1200 | 870 | 42 | Not applied | γ | — | — | — | 6.7 | 2.0 |
| J | Hot-rolled | 1200 | 870 | 71 | Not applied | γ | — | — | — | 5.9 | 2.1 |
| K | Hot-rolled | 1200 | 870 | 71 | Not applied | γ | — | — | — | 7.8 | 1.0 |
| L | Hot-rolled | 1150 | 790 | 71 | Not applied | γ | — | — | — | 11.0 | 1.4 |

Underlined values are outside range of the invented steel.

TABLE 2-2

| | | Surface condition | | | Mechanical properties | | | Shape fixation property index | Drawability | |
|---|---|---|---|---|---|---|---|---|---|---|
| Steel | Classification | Ra (μm) | Lubrication coating | Friction coefficient | σY (MPa) | σB (MPa) | E1 (%) | Δd/σB* (mm/MPa) | index (D/d) | Remarks |
| A | Hot-rolled | 2.1 | Applied | 0.06 | 221 | 311 | 47 | 38 | 2.29 | Invented steel |
| B | Hot-rolled | 1.6 | Not applied | 0.22 | 161 | 281 | 56 | 41 | 1.86 | Comparative steel |
| C | Hot-rolled | 1.9 | Applied | 0.14 | 220 | 369 | 42 | 40 | 1.91 | Comparative steel |
| D | Hot-rolled | 2.0 | Applied | 0.17 | 195 | 306 | 44 | 44 | 1.97 | Comparative steel |

TABLE 2-2-continued

| Steel | Classification | Surface condition: Ra (μm) | Surface condition: Lubrication coating | Surface condition: Friction coefficient | Mechanical properties: σY (MPa) | Mechanical properties: σB (MPa) | Mechanical properties: E1 (%) | Shape fixation property index: Δd/σB* (mm/MPa) | Drawability index (D/d) | Remarks |
|---|---|---|---|---|---|---|---|---|---|---|
| E | Hot-rolled | 2.2 | Applied | 0.12 | 422 | 637 | 29 | 41 | 2.06 | Invented steel |
| F-1 | Hot-rolled | 2.3 | Applied | 0.09 | 438 | 668 | 28 | 43 | 2.09 | Invented steel |
| F-2 | Hot-rolled | 1.4 | Applied | 0.07 | 423 | 655 | 29 | 43 | 2.23 | Invented steel |
| F-3 | Hot-rolled | 1.5 | Not applied | 0.23 | 419 | 649 | 29 | 69 | 1.80 | Comparative steel |
| F-4 | Hot-rolled | 3.7 | Applied | 0.21 | 420 | 661 | 28 | 58 | 1.83 | Comparative steel |
| F-5 | Hot-rolled | 2.0 | Not applied | 0.22 | 431 | 660 | 28 | 60 | 1.83 | Comparative steel |
| F-6 | Hot-rolled | 2.3 | Not applied | 0.23 | 400 | 622 | 32 | 55 | 1.77 | Comparative steel |
| F-7 | Cold-rolled | 0.5 | Applied | 0.08 | 418 | 671 | 28 | 36 | 2.11 | Invented steel |
| F-8 | Cold-rolled | 0.6 | Not applied | 0.10 | 433 | 667 | 28 | 52 | 2.09 | Comparative steel |
| F-9 | Cold-rolled | 0.6 | Applied | 0.07 | 552 | 721 | 20 | 55 | 2.17 | Comparative steel |
| F-10 | Cold-rolled | 0.5 | Not applied | 0.11 | 570 | 710 | 21 | 61 | 2.09 | Comparative steel |
| G | Hot-rolled | 2.2 | Applied | 0.12 | 441 | 661 | 30 | 52 | 2.00 | Invented steel |
| H | Hot-rolled | 1.8 | Applied | 0.15 | 776 | 986 | 16 | 43 | 1.97 | Invented steel |
| I | Hot-rolled | 1.9 | Applied | 0.16 | 404 | 638 | 27 | 35 | 1.91 | Invented steel |
| J | Hot-rolled | 2.1 | Applied | 0.11 | 431 | 623 | 26 | 36 | 2.03 | Invented steel |
| K | Hot-rolled | 2.4 | Applied | 0.13 | 425 | 627 | 30 | 33 | 2.06 | Invented steel |
| L | Hot-rolled | 2.1 | Applied | 0.13 | 401 | 588 | 25 | 41 | 2.06 | Invented steel |

*× 1000

Underlined values are outside range of the invented steel.

TABLE 3

| Steel | Chemical composition (in mass %): C | Si | Mn | P | S | Al | N | Ti | Nb | Ti* | Others | Remarks |
|---|---|---|---|---|---|---|---|---|---|---|---|---|
| A | 0.035 | 0.95 | 1.35 | 0.005 | 0.0008 | 0.031 | 0.0013 | 0.147 | — | 0.001 | B: 0.005, Ca: 0.0012 | Invented steel |
| B | 0.002 | 0.61 | 0.41 | 0.084 | 0.0010 | 0.015 | 0.0011 | 0.055 | — | 0.042 | | Comparative steel |
| C | 0.055 | 0.61 | 1.45 | 0.005 | 0.0011 | 0.035 | 0.0012 | 0.181 | 0.095 | 0.004 | REM: 0.0008 | Invented steel |
| D | 0.016 | 0.02 | 0.20 | 0.010 | 0.0010 | 0.022 | 0.0017 | 0.025 | — | −0.046 | | Comparative steel |
| E | 0.025 | 0.88 | 0.95 | 0.008 | 0.0007 | 0.024 | 0.0016 | 0.110 | 0.027 | 0.017 | Cu: 1.15, Nl: 0.48 | Invented steel |
| F | 0.120 | 0.11 | 1.12 | 0.018 | 0.0020 | 0.018 | 0.0026 | 0.021 | — | −0.471 | | Comparative steel |
| G | 0.033 | 1.61 | 0.42 | 0.007 | 0.0011 | 0.022 | 0.0018 | 0.133 | 0.036 | 0.012 | Mo: 0.08 | Invented steel |
| H | 0.027 | 0.18 | 2.43 | 0.007 | 0.0012 | 0.031 | 0.0015 | 0.126 | — | 0.011 | Cr: 0.5 | Invented steel |
| I | 0.037 | 0.89 | 1.41 | 0.003 | 0.0401 | 0.022 | 0.0022 | 0.121 | 0.031 | −0.079 | | Comparative steel |
| J | 0.024 | 0.91 | 0.45 | 0.011 | 0.0009 | 0.031 | 0.0019 | 0.125 | — | 0.021 | Zr: 0.03 | Invented steel |
| K | 0.038 | 0.88 | 1.65 | 0.007 | 0.0010 | 0.036 | 0.0061 | 0.132 | — | −0.042 | | Comparative steel |
| L | 0.030 | 0.88 | 0.71 | 0.005 | 0.0008 | 0.036 | 0.0021 | 0.119 | 0.045 | 0.014 | V: 0.032 | Invented steel |

Underlined values are outside range of the invented steel.

TABLE 4-1

| Steel | Classification | Production conditions: Hot rolling process: SRT (° C.) | FT (° C.) | Ar3 + 100 (° C.) | Reduction ratio (%) | Lubrication | CT (° C.) | Cold rolling and annealing processes: TO (° C.) | Cold reduction ratio (%) | ST (° C.) | Ac3 + 10 (° C.) | Time (S) |
|---|---|---|---|---|---|---|---|---|---|---|---|---|
| A-1 | Hot-rolled | 1230 | 890 | 915 | 42 | Not applied | 500 | 798 | — | — | — | — |
| A-2 | Hot-rolled | 1230 | 920 | 915 | 0 | Not applied | 550 | 798 | — | — | — | — |
| A-3 | Hot-rolled | 1230 | 890 | 915 | 42 | Not applied | 700 | 798 | — | — | — | — |
| A-4 | Hot-rolled | 1230 | 890 | 915 | 42 | Applied | 500 | 798 | — | — | — | — |
| A-5 | Hot-rolled | 1230 | 890 | 915 | 42 | Applied | 500 | 798 | — | — | — | — |
| A-6 | Hot-rolled | 1230 | 890 | 915 | 42 | Not applied | 500 | 798 | — | — | — | — |
| A-7 | Cold-rolled | 1230 | 880 | — | — | Not applied | — | — | 65 | 650 | 1049 | 90 |
| A-8 | Cold-rolled | 1230 | 880 | — | — | Applied | — | — | 74 | 820 | 1049 | 90 |

TABLE 4-1-continued

| | | Production conditions | | | | | | | | | | |
|---|---|---|---|---|---|---|---|---|---|---|---|---|
| | | Hot rolling process | | | | | | | Cold rolling and annealing processes | | | |
| Steel | Classification | SRT (° C.) | FT (° C.) | Ar3 + 100 (° C.) | Reduction ratio (%) | Lubrication | CT (° C.) | TO (° C.) | Cold reduction ratio (%) | ST (° C.) | Ac3 + 10 (° C.) | Time (S) |
| A-9 | Cold-rolled | 1230 | 880 | — | — | Applied | — | — | 81 | 820 | 1049 | 60 |
| A-10 | Cold-rolled | 1230 | 880 | — | — | Not applied | — | — | 74 | 820 | 1049 | 60 |
| B | Hot-rolled | 1180 | 890 | 992 | 71 | Not applied | 600 | 869 | — | — | — | — |
| C | Hot-rolled | 1180 | 860 | 892 | 42 | Not applied | 600 | 782 | — | — | — | — |
| D | Hot-rolled | 1180 | 890 | 990 | 71 | Not applied | 650 | 874 | — | — | — | — |
| E | Hot-rolled | 1180 | 880 | 943 | 71 | Not applied | 400 | 810 | — | — | — | — |
| F | Hot-rolled | 1180 | 850 | 886 | 42 | Not applied | 500 | 759 | — | — | — | — |
| G | Hot-rolled | 1180 | 910 | 1006 | 71 | Applied | 650 | 840 | — | — | — | — |
| H | Hot-rolled | 1180 | 800 | 812 | 30 | Applied | 550 | 739 | — | — | — | — |
| I | Hot-rolled | 1180 | 860 | 908 | 42 | Applied | 500 | 794 | — | — | — | — |
| J | Hot-rolled | 1180 | 890 | 989 | 71 | Applied | 600 | 851 | — | — | — | — |
| K | Hot-rolled | 1180 | 850 | 888 | 42 | Applied | 500 | 781 | — | — | — | — |
| L | Hot-rolled | 1180 | 900 | 966 | 71 | Applied | 650 | 833 | — | — | — | — |

Underlined values are outside range of the invented steel.

TABLE 4-2

| | | Ratios of X-ray strength to random X-ray diffraction strength | | Surface condition | | |
|---|---|---|---|---|---|---|
| Steel | Classification | Strength ratio 1 | Strength ratio 2 | Ra (μm) | Lubrication coating | Friction coefficient |
| A-1 | Hot-rolled | 6.8 | 1.9 | 2.2 | Applied | 0.08 |
| A-2 | Hot-rolled | 1.8 | 1.7 | 2.3 | Not applied | 0.21 |
| A-3 | Hot-rolled | 7.1 | 1.8 | 2.0 | Applied | 0.11 |
| A-4 | Hot-rolled | 7.7 | 1.3 | 1.9 | Applied | 0.07 |
| A-5 | Hot-rolled | 7.8 | 1.4 | 1.6 | Not applied | 0.21 |
| A-6 | Hot-rolled | 7.8 | 1.3 | 3.6 | Applied | 0.22 |
| A-7 | Cold-rolled | 1.6 | 2.5 | 0.5 | Not applied | 0.19 |
| A-8 | Cold-rolled | 5.1 | 2.2 | 0.6 | Applied | 0.07 |
| A-9 | Cold-rolled | 2.7 | 4.3 | 0.5 | Applied | 0.07 |
| A-10 | Cold-rolled | 4.6 | 2.4 | 0.5 | Applied | 0.08 |
| B | Hot-rolled | 1.2 | 6.6 | 2.1 | Not applied | 0.23 |
| C | Hot-rolled | 5.9 | 2.1 | 2.3 | Applied | 0.12 |
| D | Hot-rolled | 1.4 | 5.7 | 2.3 | Applied | 0.10 |
| E | Hot-rolled | 7.2 | 2.1 | 2.0 | Applied | 0.08 |
| F | Hot-rolled | 1.9 | 4.6 | 2.4 | Not applied | 0.22 |
| G | Hot-rolled | 8.3 | 1.5 | 1.7 | Applied | 0.12 |
| H | Hot-rolled | 4.4 | 2.2 | 1.6 | Applied | 0.09 |
| I | Hot-rolled | 1.8 | 4.6 | 1.6 | Not applied | 0.21 |
| J | Hot-rolled | 11.0 | 1.6 | 1.9 | Applied | 0.08 |
| K | Hot-rolled | 1.6 | 5.1 | 2.0 | Not applied | 0.21 |
| L | Hot-rolled | 6.7 | 2.0 | 1.3 | Applied | 0.09 |

Underlined values are outside range of the invented steel.

TABLE 4-3

| | | Mechanical properties | | | | Shape fixation property index | Drawability | |
|---|---|---|---|---|---|---|---|---|
| Steel | Classification | σY (MPa) | σB (MPa) | E1 (%) | λ (%) | Δd/σB* (mm/MPa) | index d/D | Remarks |
| A-1 | Hot-rolled | 588 | 779 | 22 | 94 | 42 | 2.10 | Invented steel |
| A-2 | Hot-rolled | 603 | 811 | 20 | 106 | 68 | 1.86 | Comparative steel |
| A-3 | Hot-rolled | 523 | 718 | 19 | 78 | 39 | 1.96 | Invented steel |
| A-4 | Hot-rolled | 576 | 791 | 22 | 90 | 40 | 1.99 | Invented steel |
| A-5 | Hot-rolled | 567 | 784 | 20 | 87 | 44 | 1.79 | Comparative steel |
| A-6 | Hot-rolled | 581 | 795 | 21 | 86 | 42 | 1.82 | Comparative steel |

TABLE 4-3-continued

| Steel | Classification | Mechanical properties σY (MPa) | σB (MPa) | E1 (%) | λ (%) | Shape fixation property index Δd/σB* (mm/MPa) | Drawability index d/D | Remarks |
|---|---|---|---|---|---|---|---|---|
| A-7 | Cold-rolled | 733 | 840 | 14 | 35 | 59 | 1.90 | Comparative steel |
| A-8 | Cold-rolled | 594 | 800 | 20 | 78 | 45 | 2.19 | Invented steel |
| A-9 | Cold-rolled | 586 | 790 | 20 | 76 | 63 | 2.01 | Comparative steel |
| A-10 | Cold-rolled | 559 | 810 | 19 | 94 | 44 | 2.15 | Invented steel |
| B | Hot-rolled | 293 | 427 | 40 | 138 | 55 | 1.88 | Comparative steel |
| C | Hot-rolled | 603 | 796 | 21 | 80 | 38 | 1.91 | Invented steel |
| D | Hot-rolled | 385 | 483 | 34 | 89 | 47 | 2.11 | Comparative steel |
| E | Hot-rolled | 580 | 785 | 23 | 106 | 39 | 2.20 | Invented steel |
| F | Hot-rolled | 571 | 769 | 18 | 35 | 49 | 1.82 | Comparative steel |
| G | Hot-rolled | 520 | 715 | 24 | 111 | 42 | 1.98 | Invented steel |
| H | Hot-rolled | 603 | 834 | 20 | 76 | 40 | 2.03 | Invented steel |
| I | Hot-rolled | 558 | 781 | 18 | 28 | 52 | 1.92 | Comparative steel |
| J | Hot-rolled | 480 | 634 | 26 | 134 | 44 | 2.14 | Invented steel |
| K | Hot-rolled | 590 | 814 | 17 | 41 | 53 | 1.93 | Comparative steel |
| L | Hot-rolled | 477 | 676 | 25 | 125 | 45 | 2.06 | Invented steel |

*× 1000

The invention claimed is:

1. A high-burring and high-strength thin steel sheet drawable having a particular shape fixation property and high burring workability, characterized in that the steel sheet and is composed in mass essentially of:

C: 0.01 to 0.035%,

Si: 0.01 to 2%,

Mn: 0.05 to 3%,

P: 0.1% or less,

S: 0.03% or less, and

Al: 0.005 to 1%,

N: 0.005% or less,

Ti: 0.05 to 0.5%, satisfying the expression Ti−(48/12)C−(48/14)N−(48/32)S>0%, and Cu-free, with the balance consisting of Fe and unavoidable impurities, wherein the steel sheet at least on a plane at a center of the thickness of at least a section has:

a. a first average ratio of an X-ray strength in an orientation component group of {100}<011> to {223}<110> to a random X-ray diffraction strength is at least 3, and b. a second average ratio of the X-ray strength in three orientation components of {554}<225>, {111}<112> and {111}<110> to the random X-ray diffraction strength is at most 3.5, and wherein the steel sheet has a microstructure composed of single phase bainitic ferrite or bainitic ferrite and less than 10% volume bainite, with unavoidable other phase, so that the steel sheet has a particular shape fixation property.

2. The steel sheet according to claim 1, wherein the steel further contains, in mass, Nb: 0.01 to 0.5%, so as to satisfy the expression:

$$Ti+(48/93)Nb-(48/12)C-(48/14)N-(48/32)S \geqq 0\%.$$

3. The steel sheet according to claim 1, wherein the steel further contains, in mass, B: 0.0002 to 0.002%.

4. The steel sheet according to claim 1, wherein the steel further contains, in mass, Ni: 0.1 to 1%.

5. The steel sheet according to claim 1, wherein the steel further contains, in mass, one or both of: Ca: 0.0005 to 0.002%, and REM: 0.0005 to 0.02%.

6. The steel sheet according to claim 1, wherein the steel further contains, in mass, one or more of:

Mo: 0.05 to 1%,

V: 0.02 to 0.2%,

Cr: 0.01 to 1%, and

Zr: 0.02 to 0.2%.

7. A high-strength thin steel sheet drawable having a particular shape fixation property and high burring workability comprised of steel sheet according to claim 1, characterized by the thin steel sheet is produced by the steps of comprising:

a) hot rolling a slab having the above ingredients, b) finish hot rolling at a total reduction ratio of 25% or more in terms of steel sheet thickness in the temperature range of the $Ar_3$ transformation temperature +100° C. or lower and at a friction coefficient between the hot rolling rolls and steel sheet of 0.2 or less for at least one pass at the time of hot rolling in the temperature region of the $Ar_3$ transformation temperature +100 C or lower, and c) cooling and coiling the hot rolled steel sheet.

* * * * *